US011395536B2

(12) United States Patent
Pacha et al.

(10) Patent No.: US 11,395,536 B2
(45) **Date of Patent: *Jul. 26, 2022**

(54) GOLF BAG STRAP SYSTEMS AND METHODS TO MANUFACTURE GOLF BAG STRAP SYSTEMS

(71) Applicant: PARSONS XTREME GOLF, LLC, Scottsdale, AZ (US)

(72) Inventors: Duane E. Pacha, Chandler, AZ (US); Candace Chen, Phoenix, AZ (US); William W. Sliger, II, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/179,028

(22) Filed: Feb. 18, 2021

(65) Prior Publication Data

US 2021/0177125 A1 Jun. 17, 2021

Related U.S. Application Data

(63) Continuation of application No. 16/459,074, filed on Jul. 1, 2019, now Pat. No. 10,932,545, which is a continuation-in-part of application No. 29/675,117, filed on Dec. 28, 2018, now Pat. No. Des. 890,524, which is a continuation-in-part of application No. 29/654,534, filed on Jun. 25, 2018, now abandoned, which is a continuation-in-part of application No. 29/634,924, filed on Jan. 25, 2018, now Pat. No. Des. 844,994, which is a continuation-in-part of application No. 29/612,038, filed on Jul. 27, 2017, (Continued)

(51) Int. Cl.

| | |
|---|---|
| ***A45F 3/04*** | (2006.01) |
| ***A63B 55/00*** | (2015.01) |
| ***A45C 13/30*** | (2006.01) |

(52) U.S. Cl.

CPC ..... *A45F 3/04* (2013.01); *A45C 13/30* (2013.01); *A63B 55/408* (2015.10); *A63B 2209/00* (2013.01)

(58) Field of Classification Search

CPC ..... A44B 11/00; A45F 3/04
USPC ..... 224/257, 259, 604, 627
See application file for complete search history.

(56) References Cited

U.S. PATENT DOCUMENTS 1,365,493 A 1/1921 Hedger
3,739,961 A * 6/1973 Soukeras ..... A45F 5/00 224/583

(Continued)

FOREIGN PATENT DOCUMENTS

GB 2481325 A 12/2011

*Primary Examiner* — Nathan J Newhouse
*Assistant Examiner* — Lester L Vanterpool

(57) ABSTRACT

Golf bag strap systems and methods to manufacture the same are generally described herein. In one example a strap system may include a strap connector having a body portion, a plurality of slots in the body portion, and a plurality of ports extending orthogonally into the plurality of slots. The strap connector may include a plurality of self-adjusting strap fitments pivotally coupled to the strap connector. Each of the plurality of self-adjusting strap fitments may independently self-pivot relative to the strap connector. Other examples may be described and claimed.

20 Claims, 16 Drawing Sheets

Related U.S. Application Data now abandoned, said application No. 16/459,074 is a continuation-in-part of application No. 16/050,260, filed on Jul. 31, 2018, now Pat. No. 10,610,002, and a continuation-in-part of application No. 29/634,924, filed on Jan. 25, 2018, now Pat. No. Des. 844,994, which is a continuation-in-part of application No. 29/612,038, filed on Jul. 27, 2017, now abandoned.

(60) Provisional application No. 62/539,640, filed on Aug. 1, 2017, provisional application No. 62/693,286, filed on Jul. 2, 2018.

(56) References Cited

U.S. PATENT DOCUMENTS 4,750,652 A * 6/1988 Grant ..... F41C 33/0236 224/579
5,361,953 A * 11/1994 Nichols ..... F41C 33/046 224/198
6,152,342 A * 11/2000 Suk ..... A63B 55/408 224/259
6,283,350 B1 * 9/2001 Gottmeier ..... A45F 3/04 224/638
6,530,129 B1 * 3/2003 Cheng ..... A45F 3/14 224/264
6,568,575 B1 * 5/2003 Bartholomew ..... A45F 3/14 224/655
6,687,963 B1 * 2/2004 Chang ..... A45F 3/14 24/579.11
D522,244 S 6/2006 Toler et al.
7,131,534 B2 11/2006 Enes
7,198,183 B2 * 4/2007 Yang ..... A45F 3/12 24/615
8,186,549 B2 5/2012 Campbell et al.
8,322,585 B2 12/2012 Herron et al.
D810,443 S * 2/2018 Burgess ..... D3/327
10,245,486 B2 * 4/2019 Burgess ..... A63B 55/408
10,449,429 B2 * 10/2019 Bruce ..... A63B 55/408
2002/0088836 A1 * 7/2002 Batten ..... A45F 3/047 224/645
2003/0121942 A1 * 7/2003 Chang ..... A63B 55/408 224/264
2008/0156839 A1 7/2008 Betcher et al.
2012/0267410 A1 * 10/2012 Loudenslager ..... A45F 3/14 206/315.3
2013/0036535 A1 * 2/2013 Bergkvist ..... A45F 3/04 2/455
2015/0136825 A1 * 5/2015 Kalck ..... A63B 55/00 224/653

* cited by examiner

GOLF BAG STRAP SYSTEMS AND METHODS TO MANUFACTURE GOLF BAG STRAP SYSTEMS

CROSS REFERENCE

This application is a continuation of U.S. application Ser. No. 16/459,074, filed Jul. 1, 2019, which is a continuation-in-part of U.S. application Ser. No. 29/675,117, filed Dec. 28, 2018, now U.S. Pat. No. D890,524, which is a continuation-in-part of U.S. application Ser. No. 29/654,534, filed Jun. 25, 2018, which is a continuation-in-part of U.S. application Ser. No. 29/634,924, filed Jan. 25, 2018, now U.S. Pat. No. D844,994, which is a continuation-in-part of U.S. application Ser. No. 29/612,038, filed Jul. 27, 2017.

U.S. application Ser. No. 16/459,074, filed Jul. 1, 2019, is a continuation-in-part of U.S. application Ser. No. 16/050,260, filed Jul. 31, 2018, now U.S. Pat. No. 10,610,002, which claims the benefit of U.S. Provisional Application No. 62/539,640, filed Aug. 1, 2017.

U.S. application Ser. No. 16/050,260, filed Jul. 31, 2018, now U.S. Pat. No. 10,610,002, is a continuation-in-part of U.S. application Ser. No. 29/634,924, filed Jan. 25, 2018, now U.S. Pat. No. D844,994, which is a continuation-in-part of U.S. application Ser. No. 29/612,038, filed Jul. 27, 2017.

U.S. application Ser. No. 16/459,074, filed Oct. 24, 2019, claims the benefit of U.S. Provisional Application No. 62/693,286, filed Jul. 2, 2018.

The disclosures of the above-mentioned U.S. Applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to bag straps, and more particularly, to golf bag strap systems and methods to manufacture golf bag strap systems.

BACKGROUND

A golf bag may be carried by an individual with one or more carry straps attached to the golf bag. The golf bag may hold golf clubs, golf balls, and golf accessories.

Figure 1:
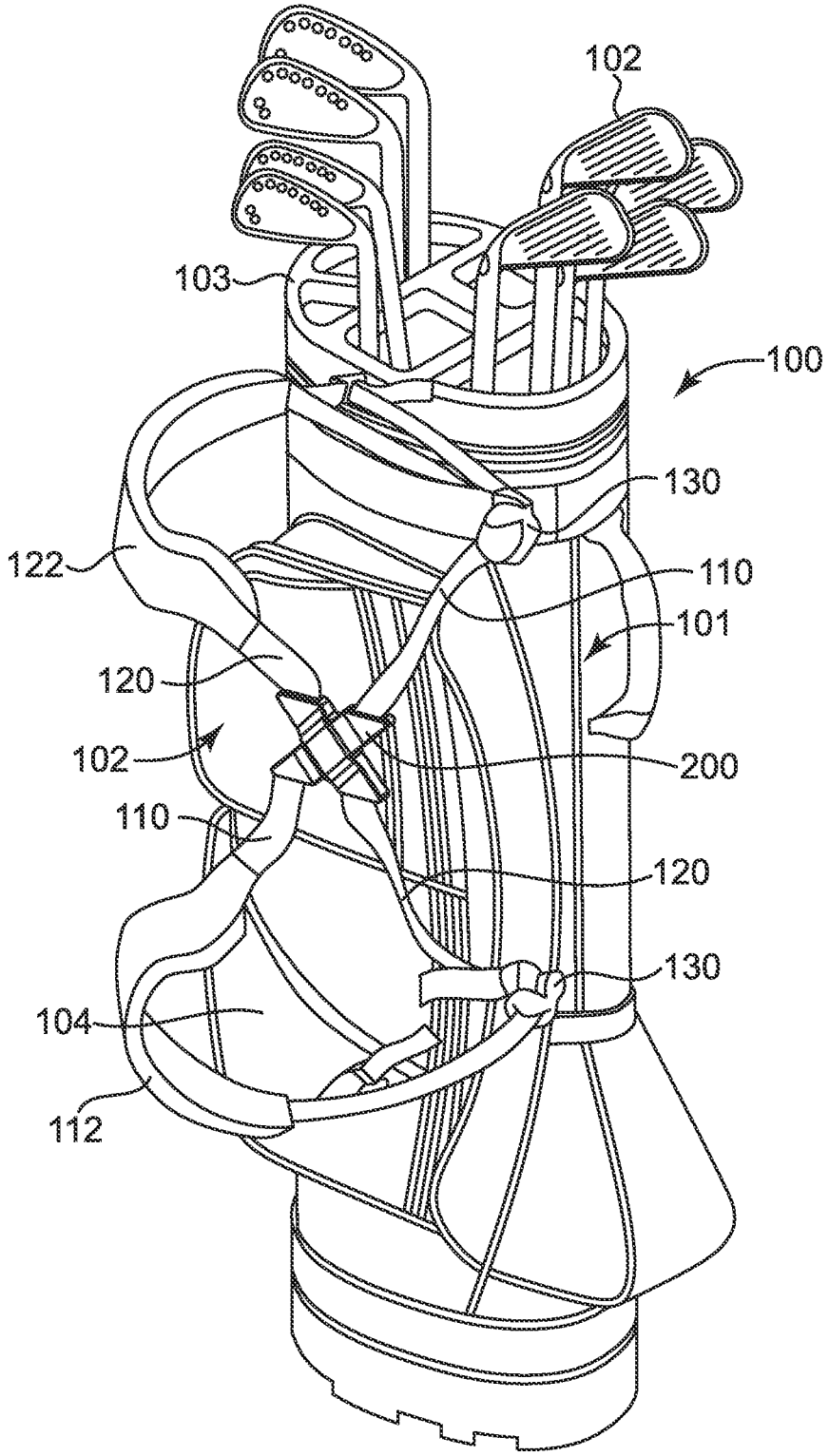
FIG. 1 depicts a perspective view of a golf bag according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf bag strap systems and methods to manufacture golf bag strap systems are described herein. The apparatus, methods, and articles of manufacture described herein are not limited in this regard.

Figure 2:
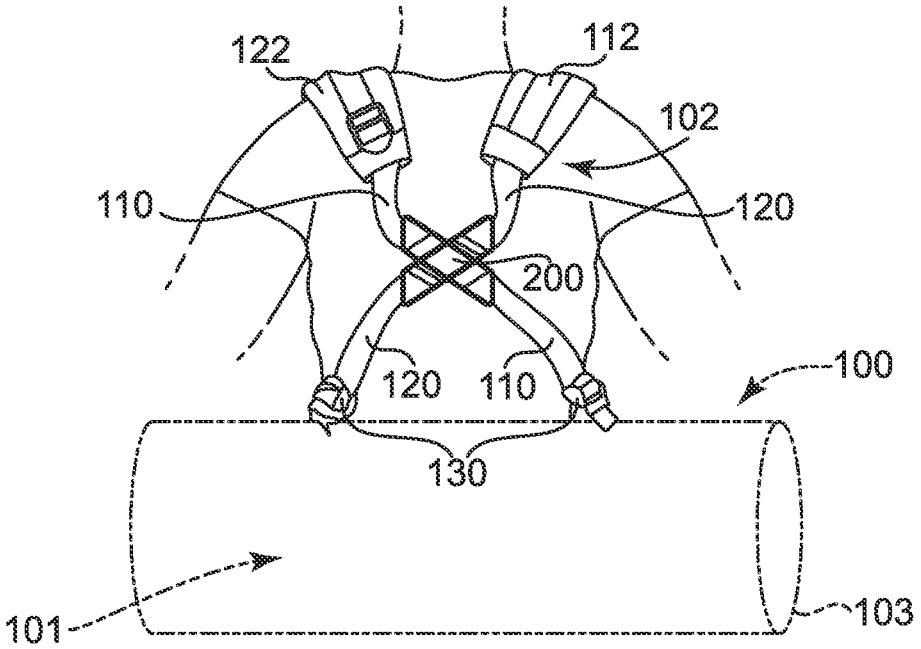
FIG. 2 depicts a perspective view of a golf bag strap system according to an embodiment of the apparatus, methods, and articles of manufacture described herein.
Figure 3:
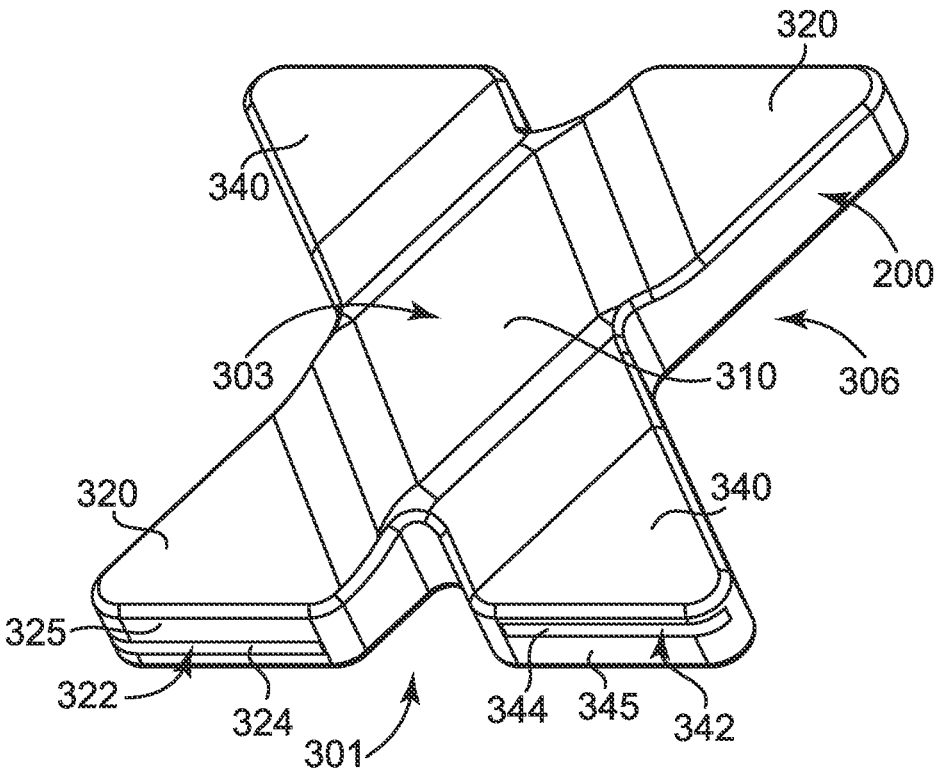
FIG. 3 depicts a perspective view of a strap connector according to an embodiment of the apparatus, methods, and articles of manufacture described herein.

In one example, as shown in FIGS. 1 and 2, a golf bag 100 may include a bag body portion 101 and a strap system 102 coupled to the bag body portion 101. The bag body portion 101 may receive one or more golf clubs 105 through a top end portion 103 and may include one or more compartments 104 for storing golf balls, golf accessories, personal items, etc. The strap system 102 may include a first strap 110, a second strap 120, and a strap connector 200. The first strap 110 and the second strap 120 may be connected to the bag body portion 101 and may cross over each other inside the strap connector 200. The first strap 110 and the second strap 120 may move freely in the strap connector 200 relative to each other and without contacting each other to self-adjust the location of the strap connector 200, and hence the configuration of the strap system 102, without any manual adjustment by an individual using the golf bag 100. The first strap 110 and the second strap 120 may include respective integrated padding 112 and 122, movable pads or cushions (not shown), and/or one or more buckles (generally shown as buckles 130) for adjusting the length of the first strap 110 and/or the second strap 120. The ends of the first strap 110 and/or the second strap 120 may be fixedly or movably (e.g., pivotally) attached to the golf bag 100. The apparatus, methods, and articles of manufacture described herein are not limited in this regard.

In one example, as shown in FIGS. 3-9, the strap connector 200 may include a front portion 301, a rear portion 302, a top portion 303, a bottom portion 304, and opposing side portions 305 and 306. The strap connector 200 may include a body portion 310, a first strap arm portion 320 extending diagonally relative to the body portion 310, and a second strap arm portion 340 extending diagonally relative to the body portion 310. The first strap arm portion 320 may be transverse to the second strap arm portion 340. The first strap arm portion 320 and the second strap arm portion 340 may define an X-shape configuration, which may be symmetrical or substantially symmetrical relative to a first center axis 512 and a second center axis 514 of the body portion 310. The first center axis 512 may be transverse to the second center axis 514. Accordingly, the strap connector 200 may have vertical and/or horizontal symmetry. The apparatus, methods, and articles of manufacture described herein are not limited in this regard.

Figure 4:
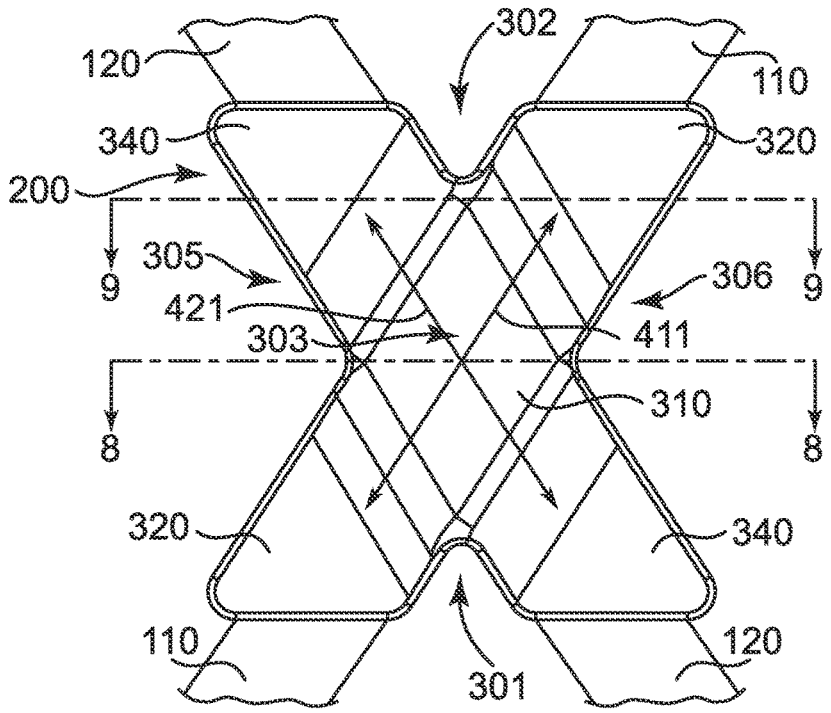
FIG. 4 depicts a top view of the strap connector of FIG. 3.
Figure 5:
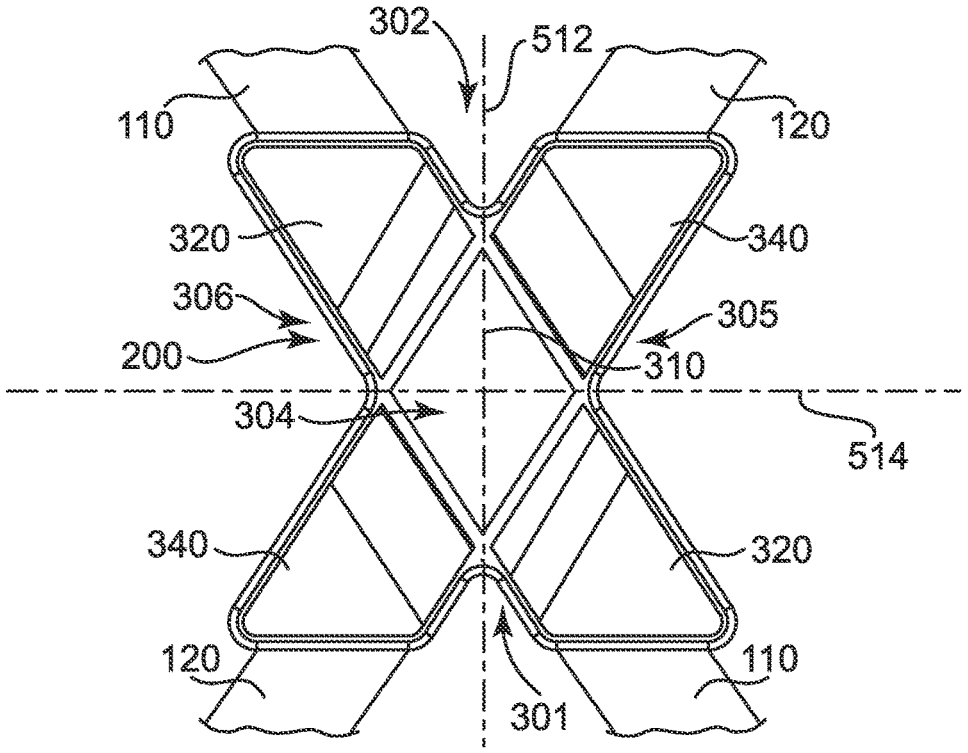
FIG. 5 depicts a bottom view of the strap connector of FIG. 3.
Figure 6:
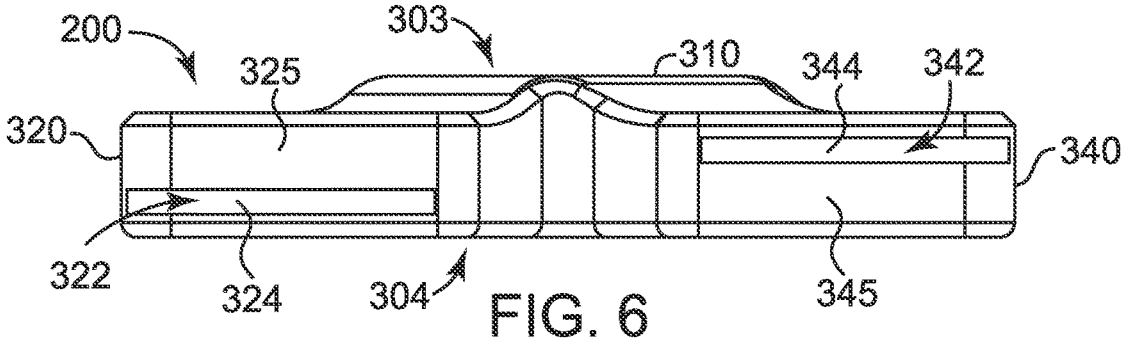
FIG. 6 depicts a front side view of the strap connector of FIG. 3.
Figure 7:
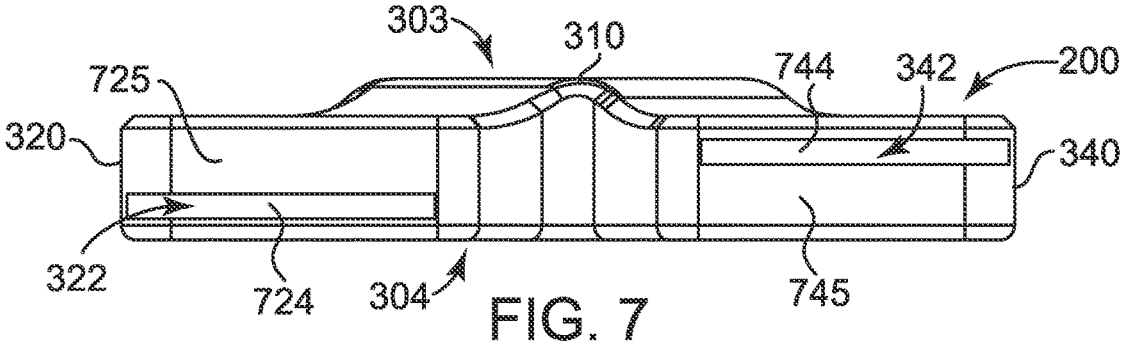
FIG. 7 depicts a rear side view of the strap connector of FIG. 3.
Figure 8:
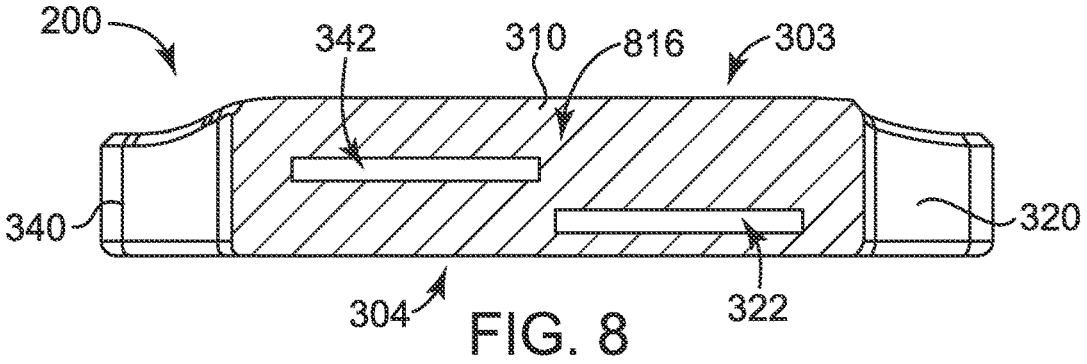
FIG. 8 is a cross sectional view of the strap connector of FIG. 3 taken at line 8-8 of FIG. 4.
Figure 9:
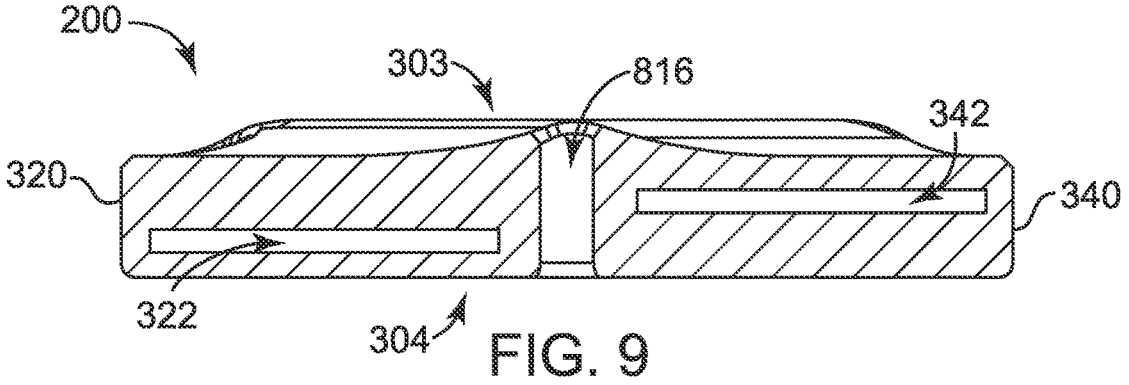
FIG. 9 is a cross sectional view of the strap connector of FIG. 3 taken at line 9-9 of FIG. 4.
Figure 10:
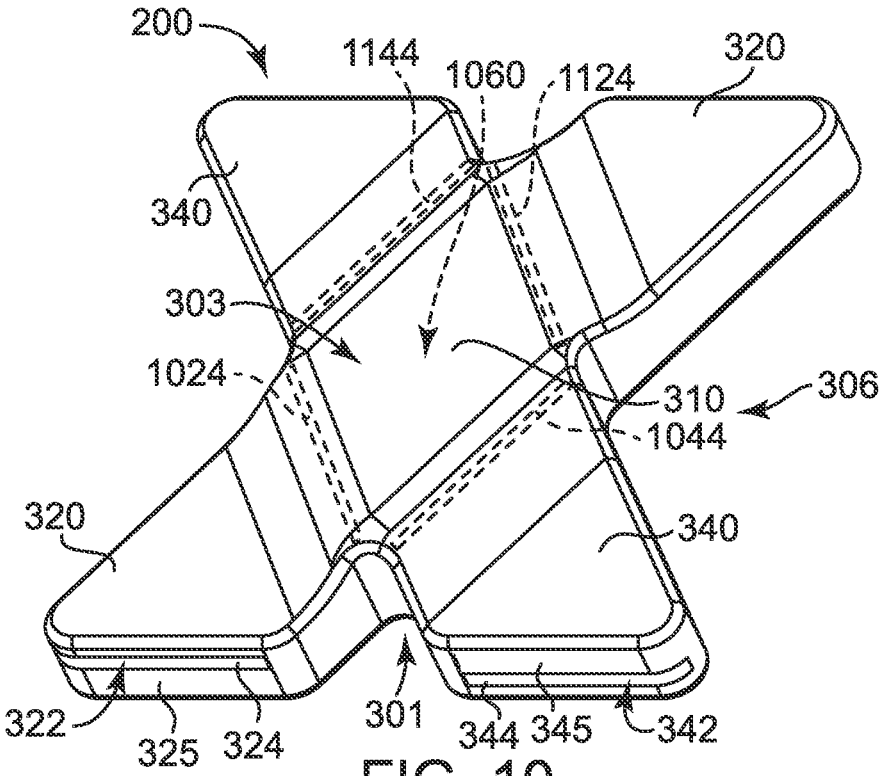
FIG. 10 depicts a perspective view of a strap connector according to an embodiment of the apparatus, methods, and articles of manufacture described herein.

In one example, as shown in FIGS. 3-9, the first strap arm portion 320 may include a first channel 322 extending through the entire length of the first strap arm portion 320. The first channel 322 may be substantially straight and may include a first opening 324 at a first longitudinal end 325 of the first strap arm portion 320 and a second opening 724 at a second and opposite longitudinal end 725 of the first strap arm portion 320. The first opening 324 and/or the second opening 724 may have any shape. The first and second openings 324 and 724 may be slits positioned between the top portion 303 and the bottom portion 304 of the strap connector 200. The first and second openings 324 and 724 may extend across the respective first and second longitudinal ends 325 and 725 in a sideways direction toward a corresponding one of the opposing side portions 305 and 306 of the strap connector 200. The first and second openings 324 and 724 may be similar in size and may be located at similar vertical positions (i.e., vertically aligned) on the first and second longitudinal ends 325 and 725 of the first strap arm portion 320, respectively. Accordingly, the first and second openings 324 and 724 may visually coincide if the first strap arm portion 320 is viewed in a longitudinal direction from the first longitudinal end 325 to the second longitudinal end 725, or vice versa, as generally indicated in FIG. 4 by bidirectional arrow 411. The apparatus, methods, and articles of manufacture described herein are not limited in this regard.

In one example, as shown in FIGS. 3-9, the first channel 322 may be a closed channel except for the first opening 324 and the second opening 724. The first channel 322, including the first opening 324 and the second opening 724, may have a width that is greater than the width of the first strap 110 and a height that is greater than the thickness of the first strap 110. Accordingly, any portion of the first strap 110 may move or slide freely inside the first channel 322 in either direction generally indicated by bidirectional arrow 411. The interior walls of the first channel 322 may have a smooth surface or be constructed from a low friction material so as to not hinder the free movement of the first strap 110 inside the first channel 322. The apparatus, methods, and articles of manufacture described herein are not limited in this regard.

In one example, as shown in FIGS. 3-9, the second strap arm portion 340 may include a second channel 342 extending through the entire length of the second strap arm portion 340. The second channel 342 may be substantially straight and may include a first opening 344 at a first longitudinal end 345 of the second strap arm portion 340 and a second opening 744 at a second and opposite longitudinal end 745 of the second strap arm portion 340. The first opening 344 and/or the second opening 744 may have any shape. The first and second openings 344 and 744 may be slits positioned between the top portion 303 and the bottom portion 304 of the strap connector 200. The first and second openings 344 and 744 may extend across the respective first and second longitudinal ends 345 and 745 in a sideways direction toward a corresponding one of the opposite side portions 305 and 306 of the strap connector 200. The first and second openings 344 and 744 may be similar in size and may be located at similar vertical positions (i.e., vertically aligned) on the first and second longitudinal ends 345 and 745 of the second strap arm portion 340, respectively. Accordingly, the first and second openings 344 and 744 may visually coincide if the second strap arm portion 340 is viewed in a longitudinal direction from the first longitudinal end 345 to the second longitudinal end 745, or vice versa, as generally indicated in FIG. 4 by bidirectional arrow 421. The apparatus, methods, and articles of manufacture described herein are not limited in this regard.

The second channel 342 may be a closed channel except for the first opening 344 and the second opening 744. The second channel 342, including the first opening 344 and the second opening 744, may have a width that is greater than the width of the second strap 120 and a height that is greater than the thickness of the second strap 120. Accordingly, any of the second strap 120 can move or slide freely inside the second channel 342 in either direction generally indicated by bidirectional arrow 421. The interior walls of the second channel 342 may have a smooth surface or be constructed from a low friction material so as to not hinder the free movement of the second strap 120 inside the second channel 342. The apparatus, methods, and articles of manufacture described herein are not limited in this regard.

In one example, as shown in FIGS. 3-9, the first channel 322 and the second channel 342 may be vertically offset from each other with respect to their distances relative the top and bottom portions 303 and 304 of the strap connector 200. For example, the vertical position at which the first and second openings 324 and 724 of the first channel 322 are located on the first strap arm portion 320 may be lower than the vertical position at which the first and second openings 344 and 744 of the second channel 342 are located on the second strap arm portion 340. In other words, the first and second openings 324 and 724 of the first channel 322 may be closer to the bottom portion 304 of the strap connector 200 compared to the first and second openings 344 and 744 of the second channel 342. Accordingly, the first channel 322 containing the first strap 110 may extend through the body portion 310 below the second channel 342 containing the second strap 120. Alternatively, the first and second channels 322 and 342 may be vertically offset such that the first channel 322 extends through the body portion 310 above the second channel 342. The apparatus, methods, and articles of manufacture described herein are not limited in this regard.

In one example, as shown in FIGS. 3-9, the body portion 310 may include a center portion 816 that separates the first channel 322 and the second channel 342. Accordingly, the first strap 110 and the second strap 120 may be prevented from contacting each other by virtue of separate strap pathways through the first strap arm portion 320, the body portion 310, and the second strap arm portion 340. Thus, the first strap 110 and the second strap 120 may freely move or slide in the first channel 322 and the second channel 342, respectively, without any hindrance or any contact with each other. The apparatus, methods, and articles of manufacture described herein are not limited in this regard.

In one example, as shown in FIGS. 10-17, the strap connector 200 is generally similar to the one shown in FIGS. 3-9 with a few exceptions as described below. Accordingly, similar parts of the strap connector 200 of FIGS. 10-17 and FIGS. 3-9 are denoted with the same reference numbers. For example, the vertical position at which the first and second openings 324 and 724 of the first channel 322 are located on the first strap arm portion 320 may be higher than the vertical position at which the first and second openings 344 and 744 of the second channel 342 are located on the second strap arm portion 340. Accordingly, the first channel 322 and the first strap 110 may extend through the body portion 310 above the second channel 342 and the second strap 120. Alternatively, the first and second channels 322 and 342 may be vertically offset such that the first channel 322 and the first strap 110 extend through the body portion 310 below the second channel 342 and the second strap 120. The apparatus, methods, and articles of manufacture described herein are not limited in this regard.

Figure 11:
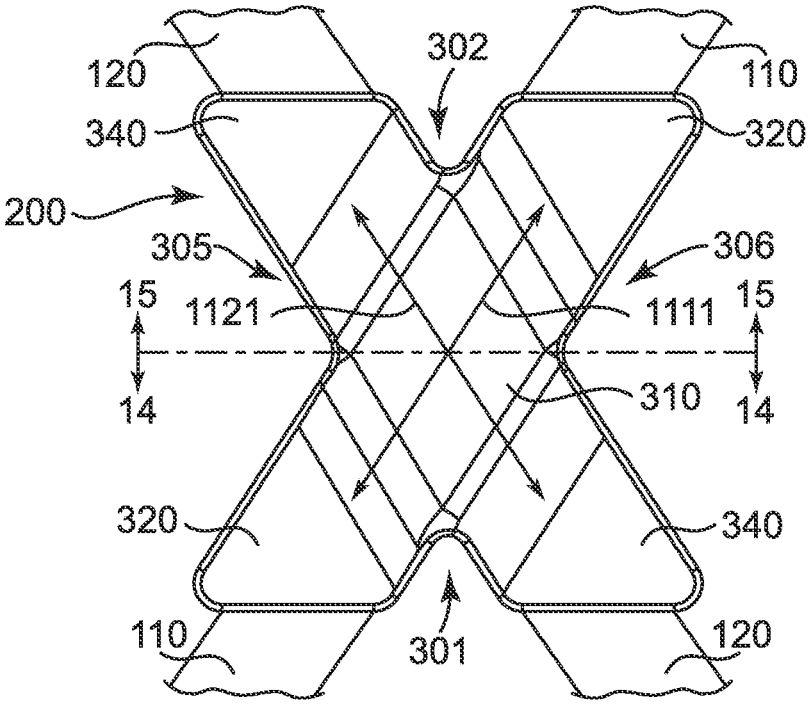
FIG. 11 depicts a top view of the strap connector of FIG. 10.
Figure 12:
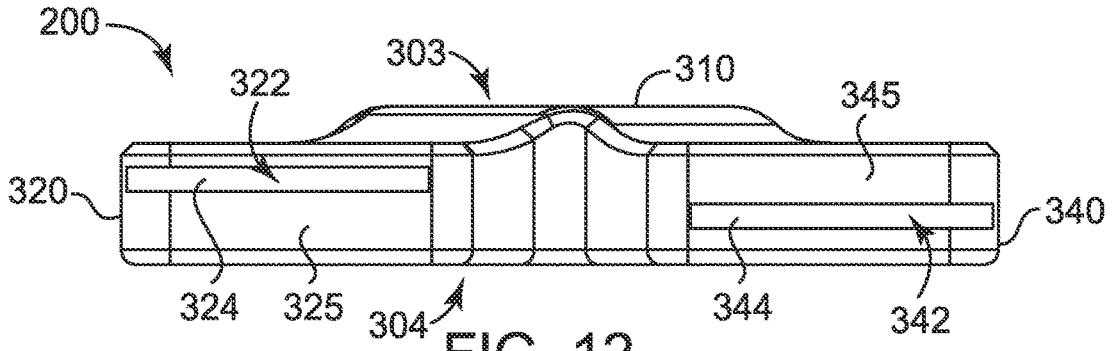
FIG. 12 depicts a front side view of the strap connector of FIG. 10.
Figure 13:
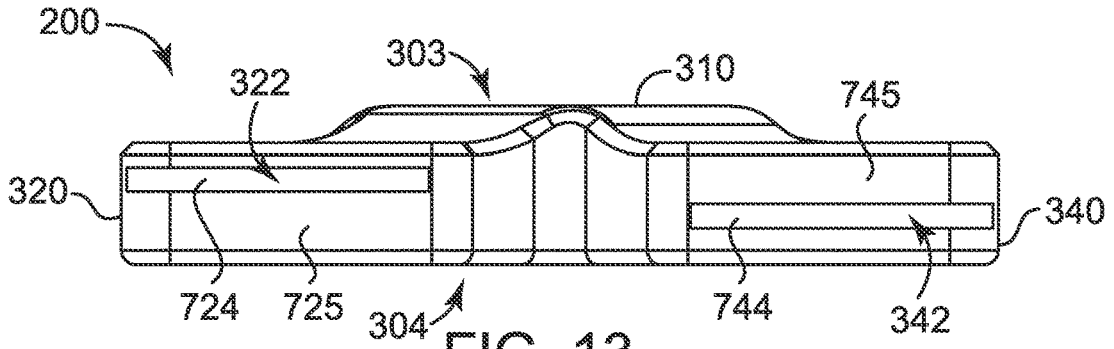
FIG. 13 depicts a rear side view of the strap connector of FIG. 10.
Figure 14:
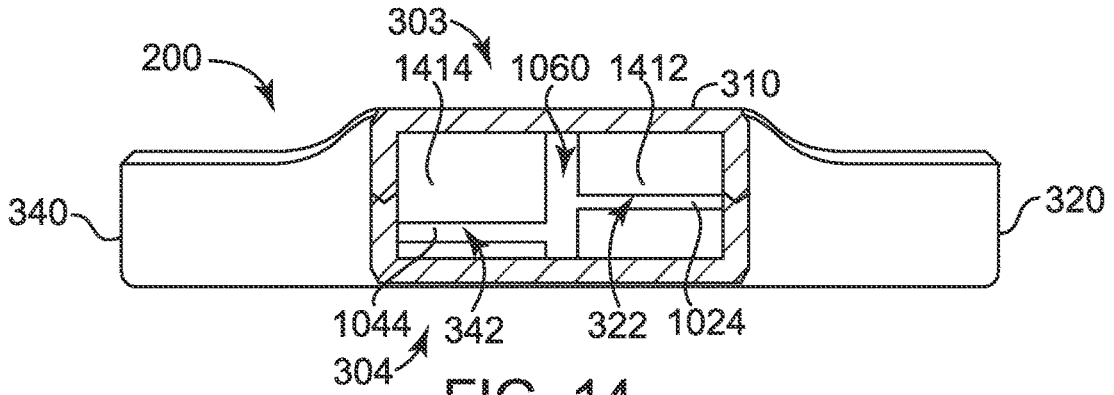
FIG. 14 depicts a cross sectional view of the strap connector of FIG. 10 taken at line 14 of FIG. 11.
Figure 15:
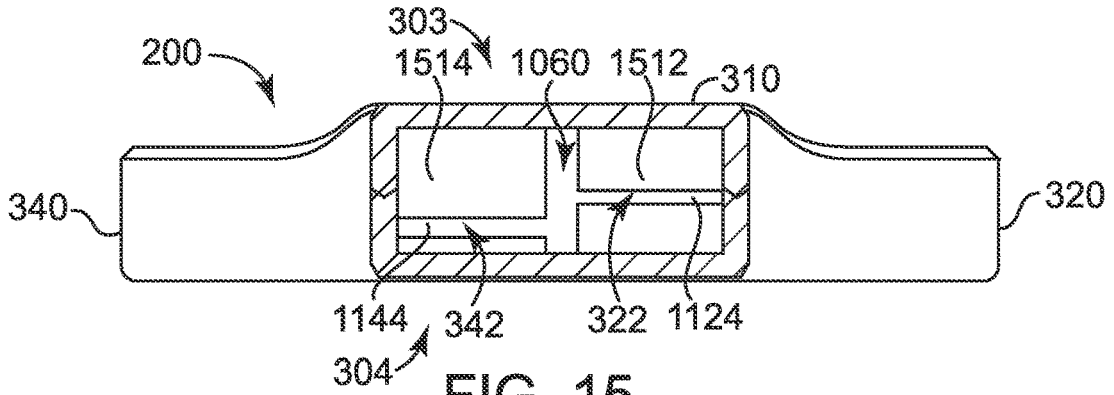
FIG. 15 depicts a cross sectional view of the strap connector of FIG. 10 taken at line 15 of FIG. 11.
Figure 16:
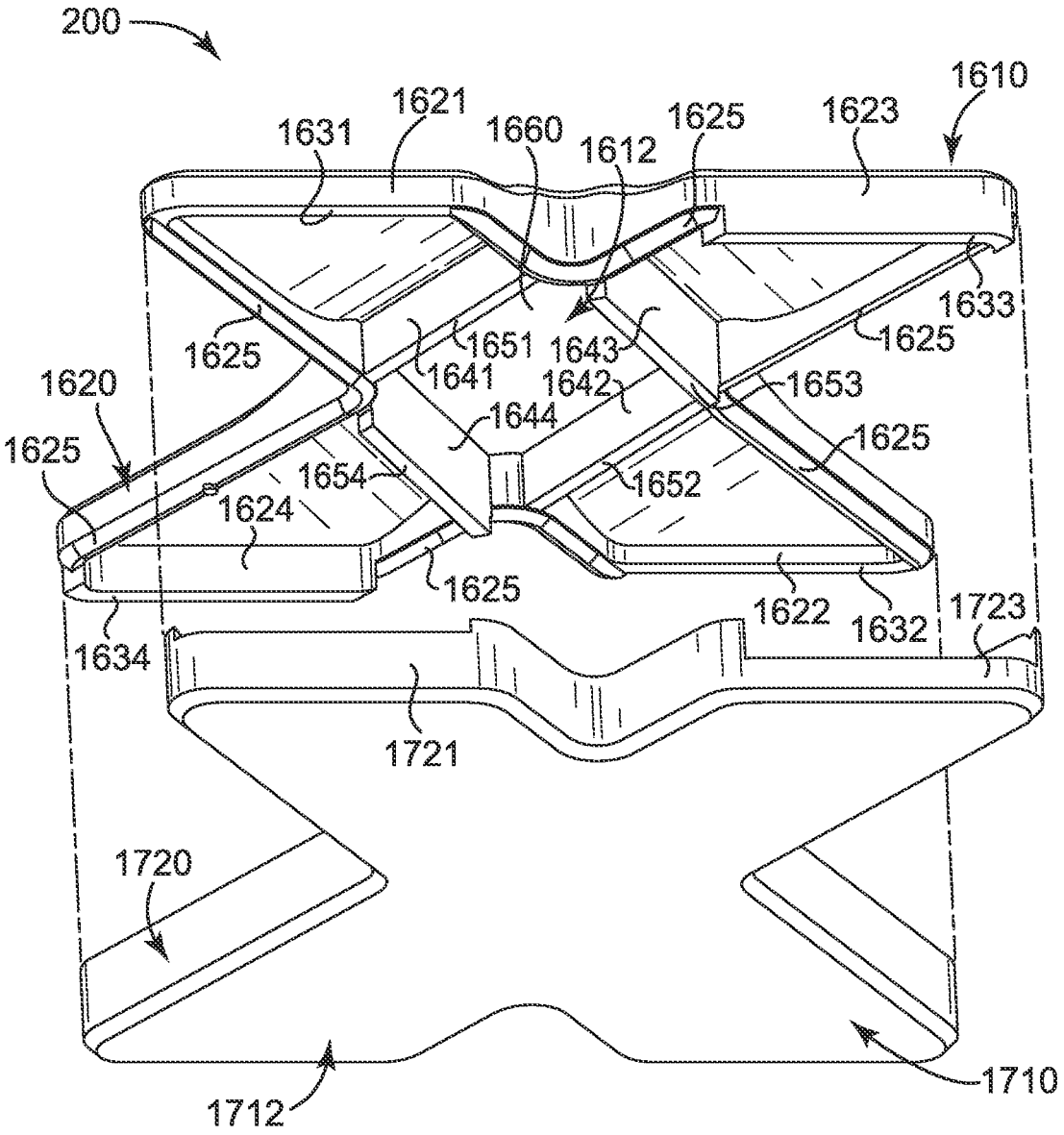
FIG. 16 depicts a bottom exploded view of the strap connector of FIG. 10.

In one example, as shown in FIGS. 10-17, the first channel 322 may include one or more openings other than the first opening 324 and the second opening 724. The one or more openings may have any shape. In one example, the first channel 322 may include a third opening 1024 and a fourth opening 1124 inside the strap connector 200 at or proximate the body portion 310. The third opening 1024 may be a slit positioned between the top and bottom portions 303 and 304 of the strap connector 200. The third opening 1024 may be at a first interior sidewall 1412 of the body portion 310 and may extend between the front and side portions 301 and 305 of the strap connector 200. The fourth opening 1124 may be a slit positioned between the top and bottom portions 303 and 304 of the strap connector 200. The fourth opening 1124 may be at a second interior sidewall 1512 of the body portion 310 and may extend between the rear and side portions 302 and 306. In one example, the third and fourth openings 1024 and 1124 of the first channel 322 may be generally aligned with each other and may be substantially parallel, parallel, or non-parallel to each other. The third and fourth openings 1024 and 1124 may be generally aligned with the first and second openings 324 and 724 of the first channel 322 and may be substantially parallel, parallel, or non-parallel thereto. The third and fourth openings 1024 and 1124 may be similar in size and may have similar vertical positions (i.e., vertically aligned) as the first and second openings 324 and 724 of the first channel 322. Accordingly, the first, second, third, and fourth openings 324, 724, 1024, and 1124 of the first channel 322 may visually coincide if the first strap arm portion 320 is viewed in a longitudinal direction from the first longitudinal end 325 to the second longitudinal end 725, or vice versa, as generally indicated in FIG. 11 by bidirectional arrow 1111. The apparatus, methods, and articles of manufacture described herein are not limited in this regard.

In one example, as shown in FIGS. 10-17, the first channel 322, including the first, second, third, and fourth openings 324, 724, 1024, and 1124, may have a width that is greater than the width of the first strap 110 and a height that is greater than the thickness of the first strap 110. Accordingly, any portion of the first strap 110 may move or slide freely inside the first channel 322 in either direction generally indicated by bidirectional arrow 1111. The interior walls of the first channel 322 may have a smooth surface or be constructed from a low friction material so as to not hinder the free movement of the first strap 110 inside the first channel 322. The apparatus, methods, and articles of manufacture described herein are not limited in this regard.

In one example, as shown in FIGS. 10-17, the second channel 342 may include one or more openings other than the first opening 344 and the second opening 744. The one or more openings may have any shape. In one example, the second channel 342 may include a third opening 1044 and a fourth opening 1144 inside the strap connector 200 at or proximate the body portion 310. The third opening 1044 may be a slit positioned between the top and bottom portions 303 and 304 of the strap connector 200. The third opening 1044 may be at a third interior sidewall 1414 of the body portion 310 and may extend between the front and side portions 301 and 306 of the strap connector 200. The fourth opening 1144 may be a slit positioned between the top and bottom portions 303 and 304 of the strap connector 200. The fourth opening 1144 may be at a fourth interior sidewall 1514 of the body portion 310 and may extend between the rear and side portions 302 and 305 of the strap connector 200. In one example, the third and fourth openings 1044 and 1144 of the second channel 342 may be generally aligned and may be substantially parallel, parallel, or non-parallel to each other. The third and fourth openings 1044 and 1144 may be generally aligned with the first and second openings 344 and 744 of the second channel 342 and may be substantially parallel, parallel, or non-parallel thereto. Additionally, the third and fourth openings 1044 and 1144 of the second channel 342 may each be adjacent the third and fourth openings 1024 and 1124 of the first channel 322. The third and fourth openings 1044 and 1144 may be similar in size and may have similar vertical positions (i.e., vertically aligned) as the first and second openings 344 and 744 of the second channel 342. Accordingly, the first, second, third, and fourth openings 344, 744, 1044, and 1144 of the second channel 342 may visually coincide if the second strap arm portion 340 is viewed in a longitudinal direction from the first longitudinal end 345 to the second longitudinal end 745, or vice versa, as generally indicated in FIG. 11 by bidirectional arrow 1121. The apparatus, methods, and articles of manufacture described herein are not limited in this regard.

In one example, as shown in FIGS. 10-17, the second channel 342, including the first, second, third, and fourth openings 344, 744, 1044, and 1144, may have a width that is greater than the width of the second strap 120 and a height that is greater than the thickness of the second strap 120. Accordingly, any portion of the second strap 120 may move or slide freely inside the second channel 342 in either direction generally indicated by bidirectional arrow 1121. The interior walls of the second channel 342 may have a smooth surface or be constructed from a low friction material so as to not hinder the free movement of the second strap 120 inside the second channel 342. The apparatus, methods, and articles of manufacture described herein are not limited in this regard.

In one example, as shown in FIGS. 10-17, the first and second channels 322 and 342 may be closed off or separate from each other except for inside an interior space 1060 of the body portion 310. Accordingly, the first and second straps 110 and 120 may be contained separately within the first and second strap arm portions 320 and 340, respectively, and may share the interior space 1060 of the body portion 310. As described herein, the first and second channels 322 and 342 may be vertically offset from each other inside the body portion 310. Accordingly, despite sharing the interior space 1060 of the body portion 310, the first and second straps 110 and 120 may be suspended inside the body portion 310 at different vertical positions, and hence, may freely move relative to each other without contacting each other inside the body portion 310. For example, the first strap 110 may be suspended above or below the second strap 120 depending on the relative vertical offset between the first and second channels 322 and 342. The apparatus, methods, and articles of manufacture described herein are not limited in this regard.

In one example, as shown in FIGS. 10-17, the strap connector 200 may be assembled from a top piece 1610 and a bottom piece 1710. The top piece 1610 may substantially define an upper portion or upper half of the strap connector 200. The top piece 1610 may include a top portion 1612 and a top peripheral wall 1620 extending downward from the top portion 1612. The top portion 1612 may have an X-shape configuration and the top peripheral wall 1620 may be contoured to the shape of the top portion 1612. With the exception of a first top wall portion 1621, a second top wall portion 1622, a third top wall portion 1623, and a fourth top wall portion 1624, the remaining portions of the top peripheral wall 1620 may include a guide portion 1625 defining a lower extent thereof. The guide portion 1625 may taper away from the remaining portion of the top peripheral wall 1620. The first and second top wall portions 1621 and 1622 may correspond to an upper portion of the first and second longitudinal ends 325 and 725 of the first strap arm portion 320, respectively, whereas the third and fourth top wall portions 1623 and 1624 may correspond to an upper portion of the first and second longitudinal ends 345 and 745 of the second strap arm portion 340, respectively. The first and second top wall portions 1621 and 1622 may have similar lower extents 1631 and 1632, respectively. The lower extents 1631 and 1632 may be flat and may be positioned higher than the guide portion 1625, positioned evenly (e.g., at the same height or substantially the same height) with the guide portion 1625, or positioned lower than the guide portion 1625 based on the desired vertical position and height of the first and second openings 324 and 724 of the first channel 322. The third and fourth top wall portions 1623 and 1624 may have similar lower extents 1633 and 1634, respectively. The lower extents 1633 and 1634 may be flat and may be positioned higher than the guide portion 1625, positioned evenly (e.g., at the same height or substantially the same height) with the guide portion 1625, or positioned lower than the guide portion 1625 based on the desired vertical position and height of the first and second openings 344 and 744 of the second channel 342. The apparatus, methods, and articles of manufacture described herein are not limited in this regard.

In one example, as shown in FIGS. 10-17, the top piece 1610 may also include a first pair of top opposing ribs 1641 and 1642 extending downward from an interior surface 1660 of the top portion 1612 and corresponding to an upper portion of the first and second interior sidewalls 1412 and 1512 of the body portion 310, respectively. The first pair of top opposing ribs 1641 and 1642 may have lower extents 1651 and 1652 positioned evenly (e.g., at the same height or substantially the same height) with the lower extents 1631 and 1632 of the first and second top wall portions 1621 and 1622 of the top peripheral wall 1620. The top piece 1610 may further include a second pair of top opposing ribs 1643 and 1644 extending downward from the interior surface 1660 of the top portion 1612 and corresponding to an upper portion of the third and fourth sidewalls 1414 and 1514 of the body portion 310, respectively. The second pair of top opposing ribs 1643 and 1644 may have lower extents 1653 and 1654 positioned evenly (e.g., at the same height or substantially the same height) with the lower extents 1633 and 1634 of the third and fourth top wall portions 1623 and 1624 of the top peripheral wall 1620. The apparatus, methods, and articles of manufacture described herein are not limited in this regard.

In one example, as shown in FIGS. 10-17, the bottom piece 1710 may substantially define a lower portion or lower half of the strap connector 200. The bottom piece 1710 may include a bottom portion 1712 and a bottom peripheral wall 1720 extending upward from the bottom portion 1712. The bottom portion 1712 may have an X-shape configuration and the bottom peripheral wall 1720 may be contoured to the shape of the bottom portion 1712. With the exception of a first bottom wall portion 1721, a second bottom wall portion 1722, a third bottom wall portion 1723, and a fourth bottom wall portion 1724, remaining portions of the bottom peripheral wall 1720 may include a guide rail portion 1725 defining an upper extent thereof and configured to receive the guide portion 1625 of the top peripheral wall 1620. The first and second bottom wall portions 1721 and 1722 may correspond to a lower portion of the first and second longitudinal ends 325 and 725 of the first strap arm portion 320, respectively, whereas the third and fourth bottom wall portions 1723 and 1724 may correspond to a lower portion of the first and second longitudinal ends 345 and 745 of the second strap arm portion 340, respectively. The first and second bottom wall portions 1721 and 1722 may have similar upper extents 1731 and 1732, respectively. The upper extents 1731 and 1732 may be flat and may be positioned higher than the guide rail portion 1725, positioned evenly with the guide rail portion 1725, or positioned lower than the guide rail portion 1725 based on the desired vertical position and height of the first and second openings 324 and 724 of the first channel 322. The third and fourth bottom wall portions 1723 and 1724 may have similar upper extents 1733 and 1734, respectively. The upper extents 1733 and 1734 may be flat and may be positioned higher than the guide rail portion 1725, positioned evenly (e.g., at the same height or substantially the same height) with the guide rail portion 1725, or positioned lower than the guide rail portion 1725 based on the desired vertical position and height of the first and second openings 344 and 744 of the second channel 342. The apparatus, methods, and articles of manufacture described herein are not limited in this regard.

In one example, as shown in FIGS. 10-17, the bottom piece 1710 may also include a first pair of bottom opposing ribs 1741 and 1742 extending upward from an interior surface 1760 of the bottom portion 1712 and corresponding to a lower portion of the first and second interior sidewalls 1412 and 1512 of the body portion 310, respectively. The first pair of bottom opposing ribs 1741 and 1742 may have upper extents 1751 and 1752 positioned evenly (e.g., at the same height or substantially the same height) with the upper extents 1731 and 1732 of the first and second bottom wall portions 1721 and 1722 of the bottom peripheral wall 1720. The bottom piece 1710 may further include a second pair of bottom opposing ribs 1743 and 1744 extending upward from the interior surface 1760 of the bottom portion 1712 and corresponding to a lower portion of the third and fourth sidewalls 1414 and 1514 of the body portion 310, respectively. The second pair of bottom opposing ribs 1743 and 1744 may have upper extents 1753 and 1754 positioned evenly (e.g., at the same height or substantially the same height) with the upper extents 1733 and 1734 of the third and fourth bottom wall portions 1723 and 1674 of the bottom peripheral wall 1720. The apparatus, methods, and articles of manufacture described herein are not limited in this regard.

Figure 17:
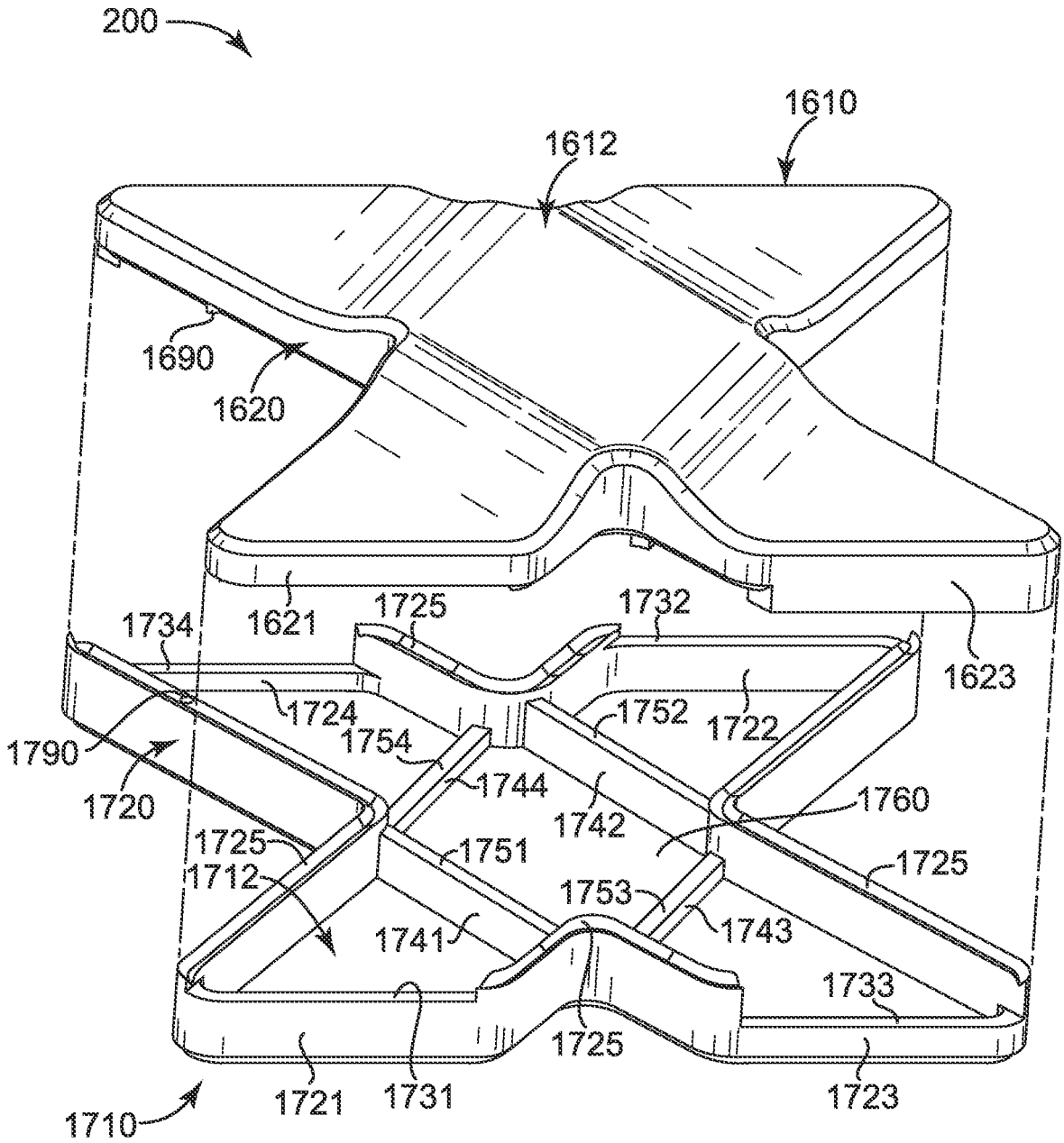
FIG. 17 depicts a top exploded view of the strap connector of FIG. 10.
Figure 18:
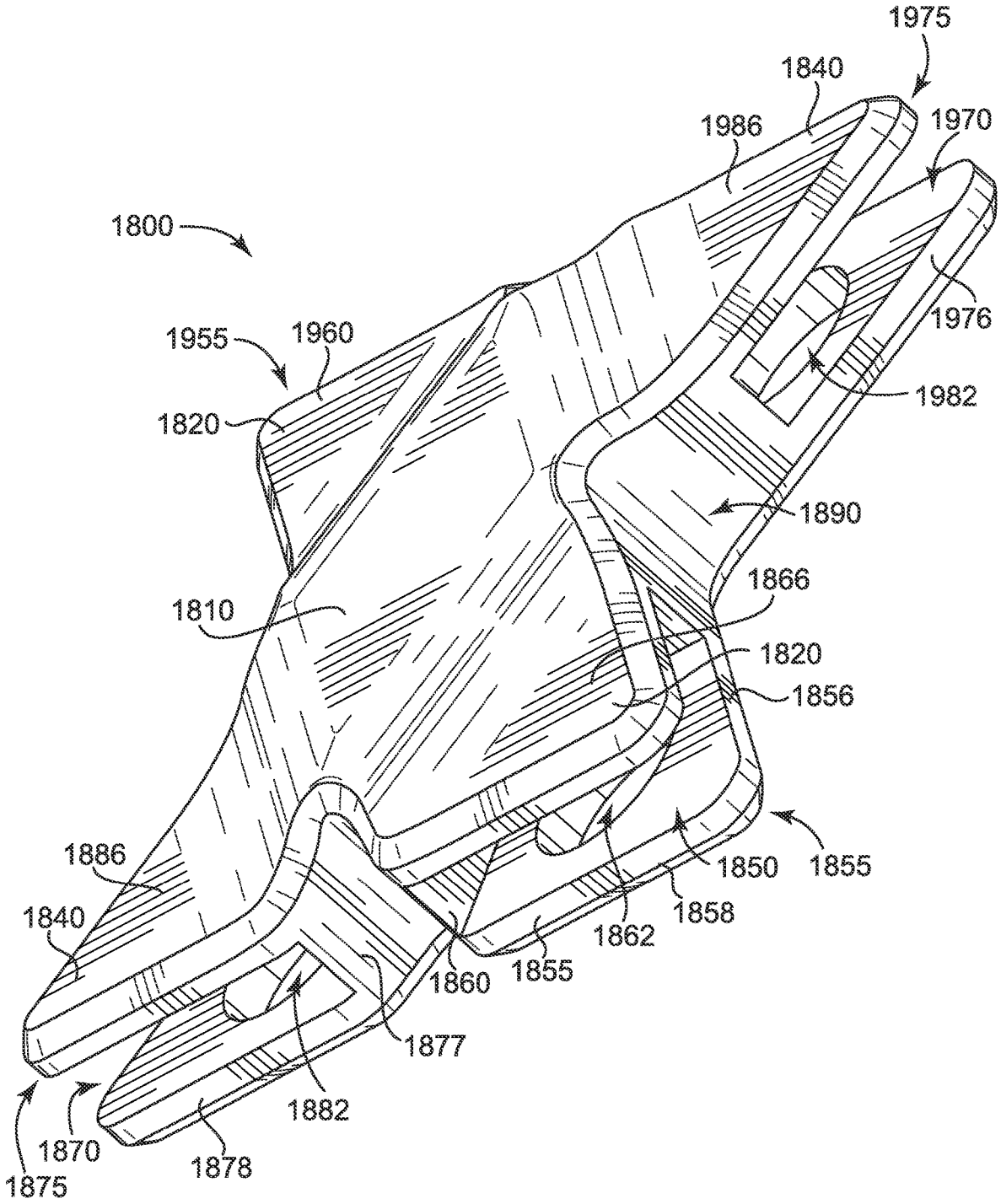
FIG. 18 depicts a perspective view of a strap connector according to an embodiment of the apparatus, methods, and articles of manufacture described herein.
Figure 19:
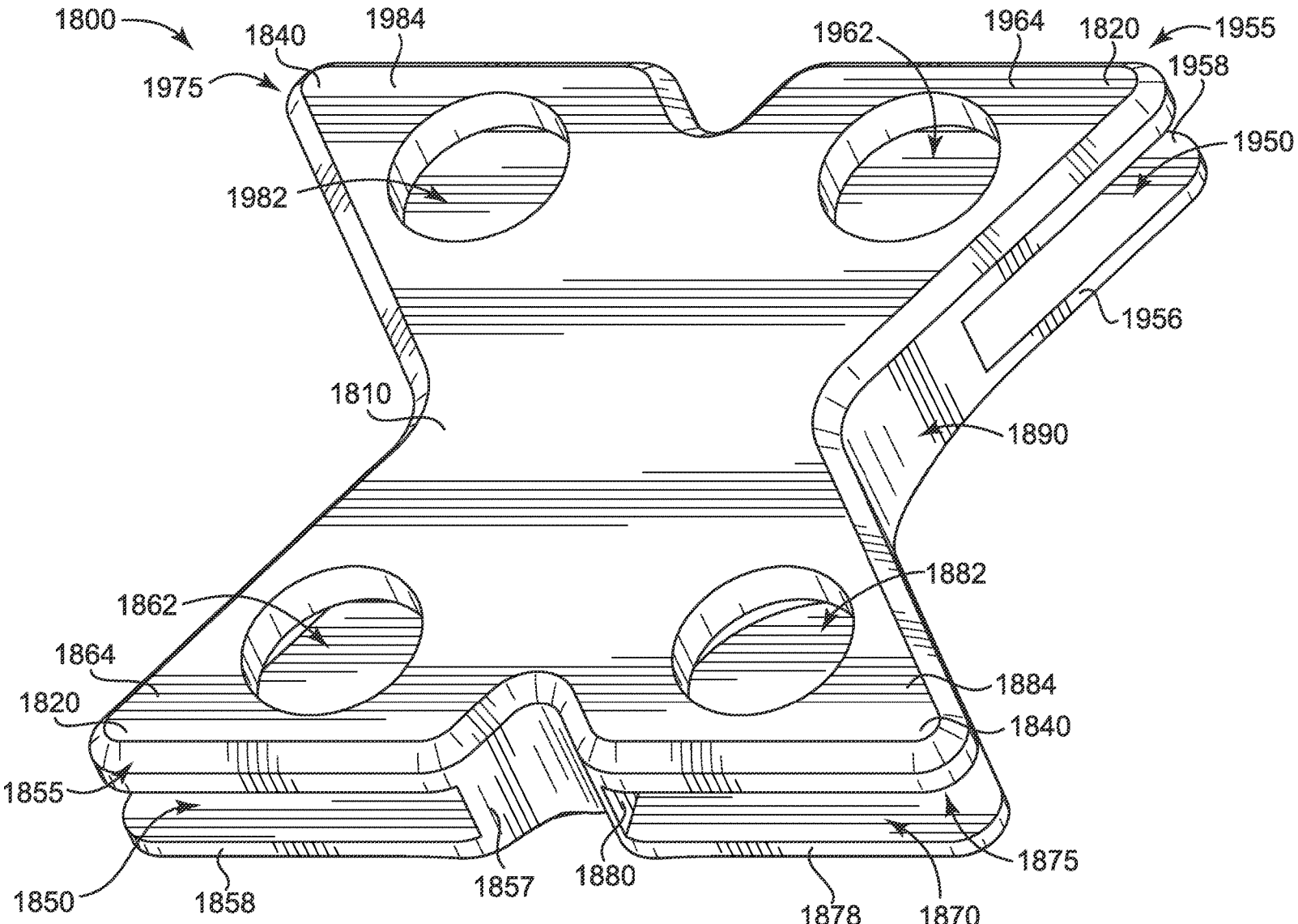
FIG. 19 depicts another perspective view of the strap connector of FIG. 18.

In one example, as shown in FIGS. 10-17, the top piece 1610 may be joined to the bottom piece 1710 by aligning the top peripheral wall 1620 and the bottom peripheral wall 1720 and receiving the guide portion 1625 of the top peripheral wall 1620 into the guide rail portion 1725 of the bottom peripheral wall 1720. In alternative examples, the guide portion 1625 may be located at the bottom peripheral wall 1720 and the guide rail portion 1725 may be located at the top peripheral wall 1620. Once the top and bottom pieces 1610 and 1710 are joined together, the resulting gap between the first top wall portion 1621 and the first bottom wall portion 1721 may correspond to the first opening 324 of the first channel 322. The resulting gap between the second top wall portion 1622 and the second bottom wall portion 1722 may correspond to the second opening 724 of the first channel 322. The resulting gaps between the first pair of top opposing ribs 1641 and 1642 and the first pair of bottom opposing ribs 1741 and 1742 may correspond to the third opening 1024 and the fourth opening 1124, respectively, of the first channel 322. Additionally, the resulting gap between the third top wall portion 1623 and the third bottom wall portion 1723 may correspond to the first opening 344 of the second channel 342. The resulting gap between the fourth top wall portion 1624 and the fourth bottom wall portion 1724 may correspond to the second opening 744 of the second channel 342. The resulting gaps between the second pair of top opposing ribs 1643 and 1644 and the second pair of bottom opposing ribs 1743 and 1744 may correspond to the third opening 1044 and the fourth opening 1144, respectively, of the second channel 342. Optionally, the guide portion 1625 of the top peripheral wall 1620 may include one or more pegs 1690 (one peg 1690 is shown in FIG. 17) configured to be received in one or more corresponding notches 1790 (one notch shown in FIG. 17) formed in the guide rail portion 1725 of the bottom peripheral wall 1720 so that the top and bottom pieces 1610 and 1710 can be assembled in only a single orientation. Alternatively, the one or more pegs 1690 may be provided at the guide rail portion 1725 and the one or more notches may be provided at the guide portion 1625. The apparatus, method, and articles of manufacture described herein are not limited in this regard.

As described herein, the strap connector 200 may be in an X-shape configuration, which allows the first strap arm portion 320 and the second strap arm portion 340 to extend away from each other as the first strap arm portion 320 and the second strap arm portion 340 extend outward form the body portion 310. Accordingly, the first strap 110 and the second strap 120 may also extend away from each other as the first strap 110 and the second strap 120 pass through the first channel 322 and the second channel 342. The separation of the first strap 110 and the second strap 120 as the first strap 110 and the second strap 120 extend through the first channel 322 and the second channel 342 in combination of with the X-shape configuration of the strap connector 200 providing for the first strap 110 and the second strap 120 to extend away from each other provide for free and unhindered movement of the first strap 110 and the second strap 120 without the first strap 110 and the second strap 120 becoming entangled or interfering with each other. The apparatus, methods, and articles of manufacture described herein are not limited in this regard.

In one example, as shown in FIGS. 18-25, a strap connector 1800 may include a body portion 1810, a first strap arm portion 1820 extending diagonally relative to the body portion 1810, and a second strap arm portion 1840 extending diagonally relative to the body portion 1810. The body portion 1810, the first strap arm portion 1820, and the second strap arm portion 1840 may be enclosed by a perimeter portion 1890 of the strap connector 1800. In the example of FIGS. 18-25, the first strap arm portion 1820 and the second strap arm portion 1840 may define an X-shaped configuration as outlined by the perimeter portion 1890 of the strap connector 1800. The strap connector 1800 may be symmetrical or substantially symmetrical relative to a first center axis 2112 and a second center axis 2114 of the body portion 1810. The first center axis 2112 may be transverse to the second center axis 2114. Accordingly, the strap connector 1800 may exhibit horizontal and/or vertical symmetry. In other examples, such as the examples shown in FIGS. 26-29, the strap connector 1800 may have any symmetrical or asymmetrical shape. The apparatus, methods, and articles of manufacture described herein are not limited in this regard.

Figure 20:
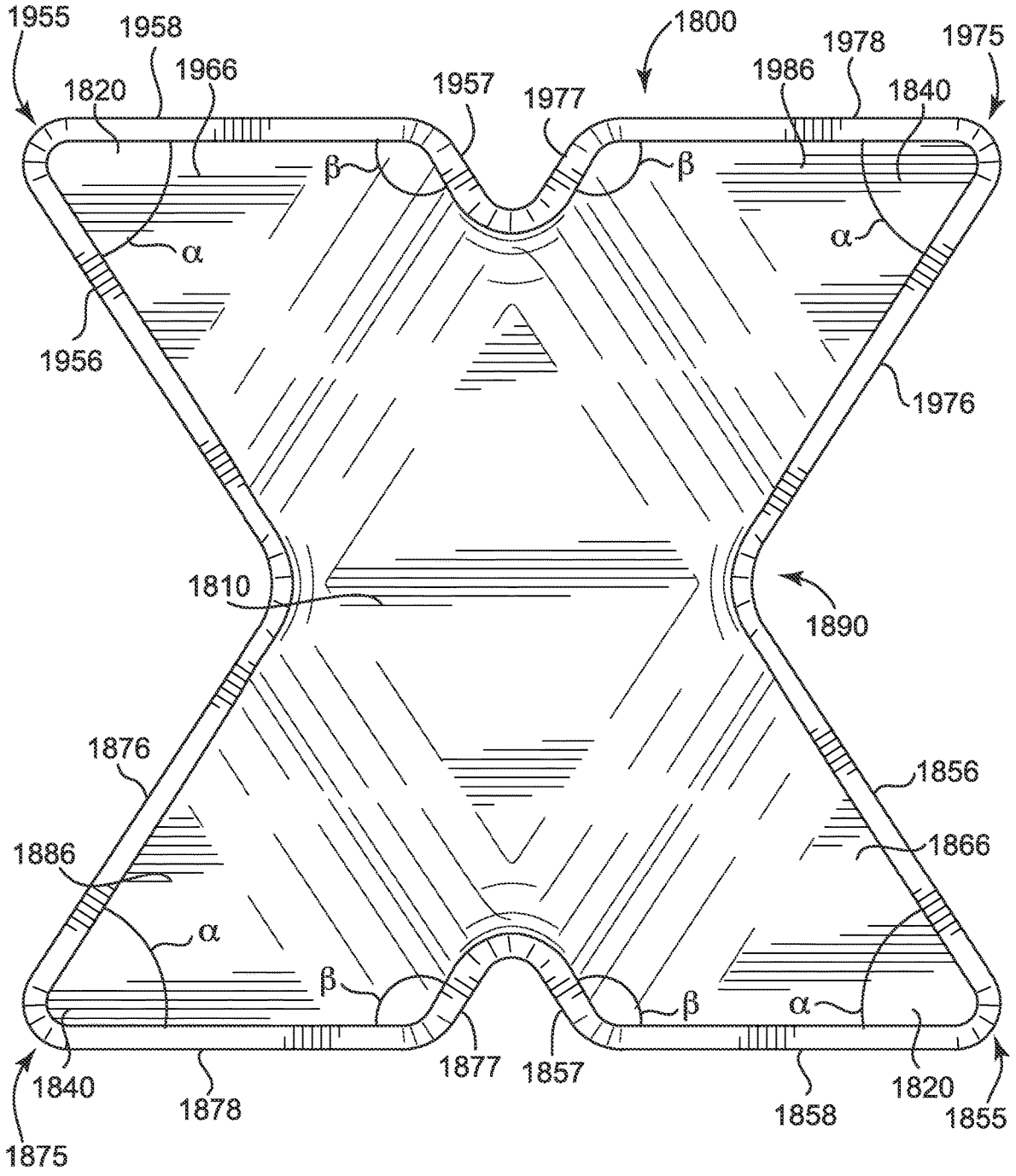
FIG. 20 depicts a top view of the strap connector of FIG. 18.

In one example, as shown in FIGS. 18-25, the first strap arm portion 1820 may include a first slot 1850 at or proximate a first longitudinal end portion 1855 and a second slot 1950 at or proximate a second longitudinal end portion 1955 opposite to the first longitudinal end portion 1855. The first longitudinal end portion 1855 may be defined by a first side portion 1856, a second side portion 1857, and a tip portion 1858 therebetween. As shown in FIGS. 18-25, the first slot 1850 may extend into the tip portion 1858 and the first side portion 1856. In another example (not shown), the first slot 1850 may further extend into the second side portion 1857. The first side portion 1856 and the second side portion 1857 may be opposite each other and may both be adjoined to the tip portion 1858. Accordingly, the first slot 1850 may span across two or more adjoining sides (e.g., the tip portion 1858 and the first side portion 1856) of the perimeter portion 1890 of the strap connector 1800. The first slot 1850 may have a depth defined by a first interior sidewall 1860 of the first strap arm portion 1820. The first interior sidewall 1860 may extend between the first side portion 1856 and the second side portion 1857 and may be curved or substantially curved resulting in the first slot 1850 having a three-dimensional shape resembling a pie-shaped wedge. Alternatively, the first interior sidewall 1860 may be linear, curvilinear, or another contour. In the illustrated example, the first side portion 1856 may have a greater extent than the second side portion 1857 and may form a smaller angle (e.g., an acute angle $\alpha$; FIG. 20) with the tip portion 1858 than does the second side portion 1857 (e.g., an obtuse angle (3; FIG. 20). The first slot 1850 may interface with a first port 1862 of the first strap arm portion 1820, with the first port 1862 extending through a first bottom portion 1864 of the first strap arm portion 1820 adjacent the first longitudinal end portion 1855. Alternatively, the first port 1862 may extend through a first top portion 1866 of the first strap arm portion 1820 adjacent the first longitudinal end portion 1855 and opposite the first bottom portion 1864. The first port 1862 may be cylindrical and may extend orthogonally or substantially orthogonally with respect to the first slot 1850. In other words, the axis of the cylinder defining the first port 1862 may be orthogonal or substantially orthogonal to a plane defining the first slot 1850. In the illustrated example, the first port 1862 may allow direct passage to and from the first slot 1850. The apparatus, methods, and articles of manufacture described herein are not limited in this regard.

The second longitudinal end portion 1955 may be defined by a first side portion 1956, a second side portion 1957, and a tip portion 1958 therebetween. As shown in FIGS. 18-25, the second slot 1950 may extend into the tip portion 1958 and the first side portion 1956. In another example (not shown), the second slot 1950 may further extend into the second side portion 1957. The first side portion 1956 and the second side portion 1957 may be opposite each other and may both be adjoined to the tip portion 1958. Accordingly, the second slot 1950 may span across two or more adjoining sides (e.g., the tip portion 1958 and the first side 1956) of the perimeter portion 1890 of the strap connector 1800. The second slot 1950 may have a depth defined by a second interior sidewall 1960 of the first strap arm portion 1820. The second interior sidewall 1960 may extend between the first side portion 1956 and the second side portion 1957 and may be curved or substantially curved resulting in the second slot 1950 having a three-dimensional shape resembling a pie-shaped wedge. Alternatively, the second interior sidewall 1960 may be linear, curvilinear, or another contour. In the illustrated example, the first side portion 1956 may have a greater extent than the second side portion 1957 and may form a smaller angle (e.g., an acute angle $\alpha$; FIG. 20) with the tip portion 1958 than does the second side portion 1957 (e.g., an obtuse angle $\beta$; FIG. 20). The second slot 1950 may interface with a second port 1962 of the first strap arm portion 1820, with the second port 1962 extending through a second bottom portion 1964 of the first strap arm portion 1820 adjacent the second longitudinal end portion 1955. Alternatively, the second port 1962 may extend through a second top portion 1966 of the first strap arm portion 1820 adjacent the second longitudinal end portion 1955 and opposite the second bottom portion 1964. The second port 1962 may be cylindrical and may extend orthogonally or substantially orthogonally with respect to the second slot 1950. In other words, the axis of the cylinder defining the second port 1962 may be orthogonal or substantially orthogonal to a plane defining the first slot 1950. In the illustrated example, the second port 1962 may allow direct passage to and from the second slot 1950. The apparatus, methods, and articles of manufacture described herein are not limited in this regard.

In one example, as shown in FIGS. 18-25, the second strap arm portion 1840 may include a first slot 1870 at or proximate a first longitudinal end portion 1875 and a second slot 1970 at or proximate a second longitudinal end portion 1975 opposite to the first longitudinal end portion 1875. The first longitudinal end portion 1875 may be defined by a first side portion 1876, a second side portion 1877, and a tip portion 1878 therebetween. As shown in FIGS. 18-25, the first slot 1870 may extend into the tip portion 1878 and the first side portion 1876. In another example (not shown), the first slot 1870 may further extend into the second side portion 1877. The first side portion 1876 and the second side portion 1877 may be opposite each other and may both be adjoined to the tip portion 1878. Accordingly, the first slot 1870 may span across two or more adjoining sides (e.g., the tip portion 1878 and the first side portion 1876) of the perimeter portion 1890 of the strap connector 1800. The first side portion 1876 may also be adjoined to the first side portion 1956 of the second longitudinal end portion 1955 of the first strap arm portion 1820 while the second side portion 1877 may also be adjoined to the second side portion 1857 of the first longitudinal end portion 1855 of the first strap arm portion 1820. The first slot 1870 may have a depth defined by a first interior sidewall 1880 of the second strap arm portion 1840. The first interior sidewall 1880 may extend between the first side portion 1876 and the second side portion 1877 and may be curved or substantially curved resulting in the first slot 1870 having a three-dimensional shape resembling a pie-shaped wedge. Alternatively, the first interior sidewall 1880 may be linear, curvilinear, or another contour. In the illustrated example, the first side portion 1876 may have a greater extent than the second side portion 1877 and may form a smaller angle (e.g., an acute angle $\alpha$; FIG. 20) with the tip portion 1878 than does the second side portion 1877 (e.g., an obtuse angle $\beta$; FIG. 20). The first slot 1870 may interface with a first port 1882 of the second longitudinal strap arm portion 1840, with the first port 1882 extending through a first bottom portion 1884 of the second strap arm portion 1840 adjacent the first longitudinal end portion 1875. Alternatively, the first 1882 may extend through a first top portion 1886 of the second strap arm portion 1840 adjacent the first longitudinal end portion 1875 and opposite the first bottom portion 1884. The first port 1882 may be cylindrical and may extend orthogonally or substantially orthogonally with respect to the first slot 1870. In other words, the axis of the cylinder defining the first port 1882 may be orthogonal or substantially orthogonal to a plane defining the first slot 1870. In the illustrated example, the first port 1882 may allow direct passage to and from the first slot 1870. The apparatus, methods, and articles of manufacture described herein are not limited in this regard.

The second longitudinal end portion 1975 may be defined by a first side portion 1976, a second side portion 1977, and a tip portion 1978 between the first side portion 1976 and the second side portion 1977. As shown in FIGS. 18-25, the second slot 1970 may extend into the tip portion 1978 and the first side portion 1976. In another example (not shown), the second slot 1970 may further extend into the second side portion 1977. The first side portion 1976 and the second side portion 1977 may be opposite each other and may both be adjoined to the tip portion 1978. Accordingly, the second slot 1970 may span across two or more adjoining sides (e.g., the tip portion 1978 and the first side portion 1976) of a perimeter portion 1890 of the strap connector 1800. The first side portion 1976 may also be adjoined to the first side portion 1856 of the first longitudinal end portion 1855 of the first strap arm portion 1820 while the second side portion 1977 may also be adjoined to the second side portion 1957 of second longitudinal end portion 1955 of the first strap arm portion 1820. The second slot 1970 may have a depth defined by a second interior sidewall 1980 of the second strap arm portion 1840. The second interior sidewall 1980 may extend between the first side portion 1976 and the second side portion 1977 and may be curved or substantially curved resulting in the second slot 1970 having a three-dimensional shape resembling a pie-shaped wedge. Alternatively, the second interior sidewall 1980 may be linear, curvilinear, or another contour. In the illustrated example, the first side portion 1976 may have a greater extent than the second side portion 1977 and may form a smaller angle (e.g., an acute angle $\alpha$; FIG. 20) with the tip portion 1978 than does the second side portion 1977 (e.g., an obtuse angle $\beta$; FIG. 20). The second slot 1970 may interface with a second port 1982 of the second longitudinal end portion 1840, with the second port 1982 extending through a second bottom portion 1984 of the second strap arm portion 1840 adjacent the second longitudinal end portion 1975. Alternatively, the second port 1982 may extend through a second top portion 1986 of the second strap arm portion 1840 adjacent the second longitudinal end portion 1975 and opposite the second bottom portion 1984. The second port 1982 may be cylindrical and may extend orthogonally or substantially orthogonally with respect to the second slot 1970. In other words, the axis of the cylinder defining the second port 1982 may be orthogonal or substantially orthogonal to a plane defining the second slot 1970. In the illustrated example, the second port 1982 may allow direct passage to and from the second slot 1970. The apparatus, methods, and articles of manufacture described herein are not limited in this regard.

In one example, as shown in FIGS. 18-25, the first and second slots 1850 and 1950 of the first strap arm portion 1820 and the first and second slots 1870 and 1970 of the second strap arm portion 1840 may each receive a strap fitment. For purposes of simplicity, one strap fitment 2120 (see FIG. 21) is shown coupled to the strap connector 1800. The strap fitment 2120 may include a first connector end portion 2130 and a second connector end portion 2140. The first connector end portion 2130 may include a loop portion 2132 engaged to a strap 2134, which in turn may be directly or indirectly coupled to a golf bag such as the golf bag 100 shown in FIGS. 1 and 2. For purposes of example, the second connector end portion 2140 may be received in the second slot 1950 of the first strap arm portion 1820. The second connector end portion 2140 may include a depressible tab 2142 located centrally on the second connector end portion 2140. The depressible tab 2142 may be circular with a smaller diameter than that of the second port 1962. The depressible tab 2142 may be biased to a position that prevents the second connector end portion 2140 from clearing the second slot 1950 without first depressing the depressible tab 2142. Accordingly, during assembly of the strap fitment 2120 to the strap connector 1800, the depressible tab 2142 is first depressed to enable the second connector end portion 2140 to be received in the second slot 1950. Once the second connector end portion 2140 is inside the second slot 1950, the depressible tab 2142 is guided toward and received in the second port 1962 so that the depressible tab 2142 can return to its biased position, thereby pivotally coupling the strap fitment 2120 to the strap connector 1800 about the depressible tab 2142. The strap fitment 2120 may be subsequently removed from the strap connector 1800 by first depressing the depressible tab 2142 and then pulling out the second connector end portion 2140 from the second slot 1950. The apparatus, methods, and articles of manufacture described herein are not limited in this regard.

Figure 21:
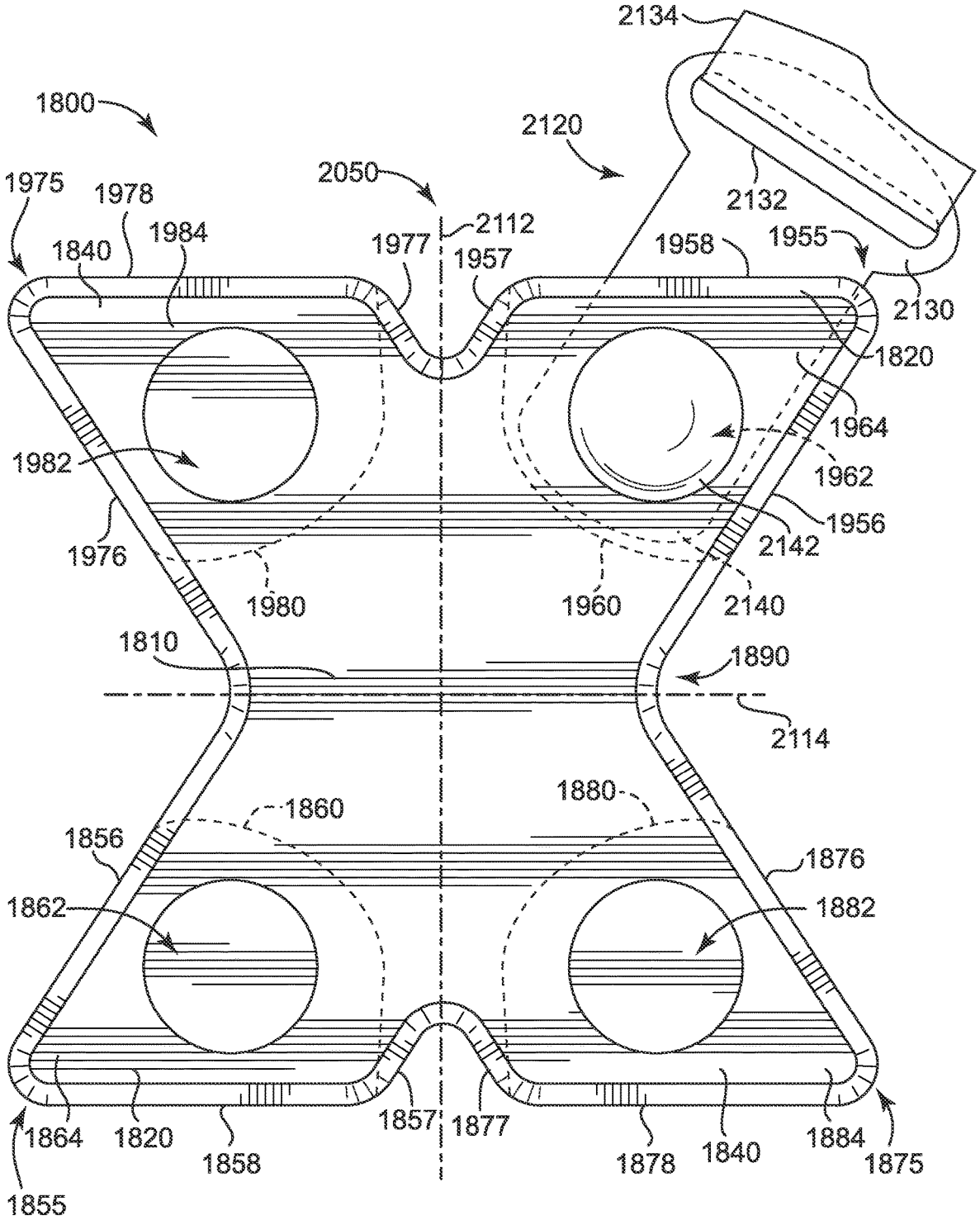
FIG. 21 depicts a bottom view of the strap connector of FIG. 18.
Figure 22:
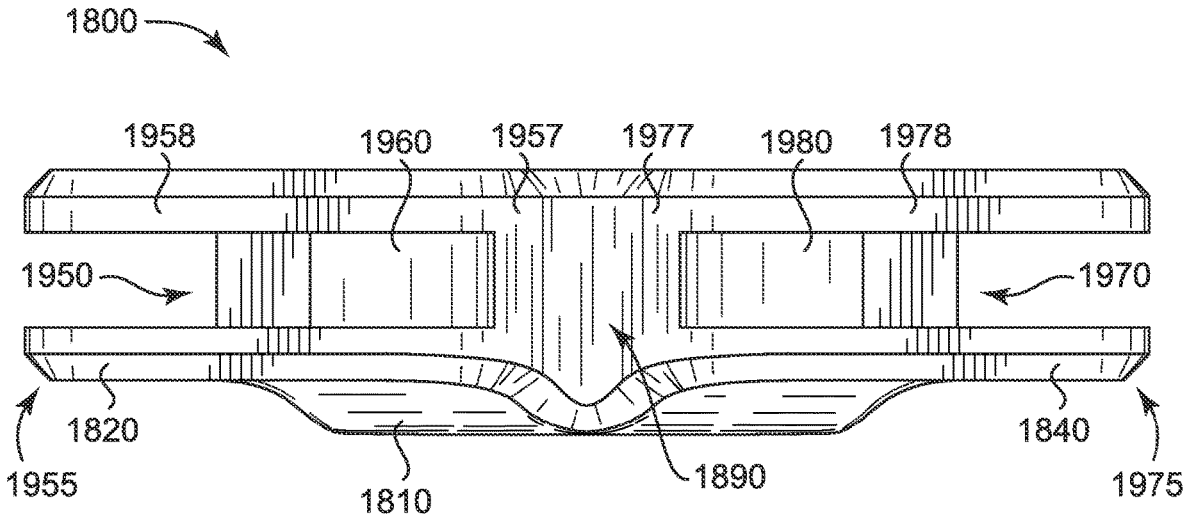
FIG. 22 depicts a front side view of the strap connector of FIG. 18.
Figure 23:
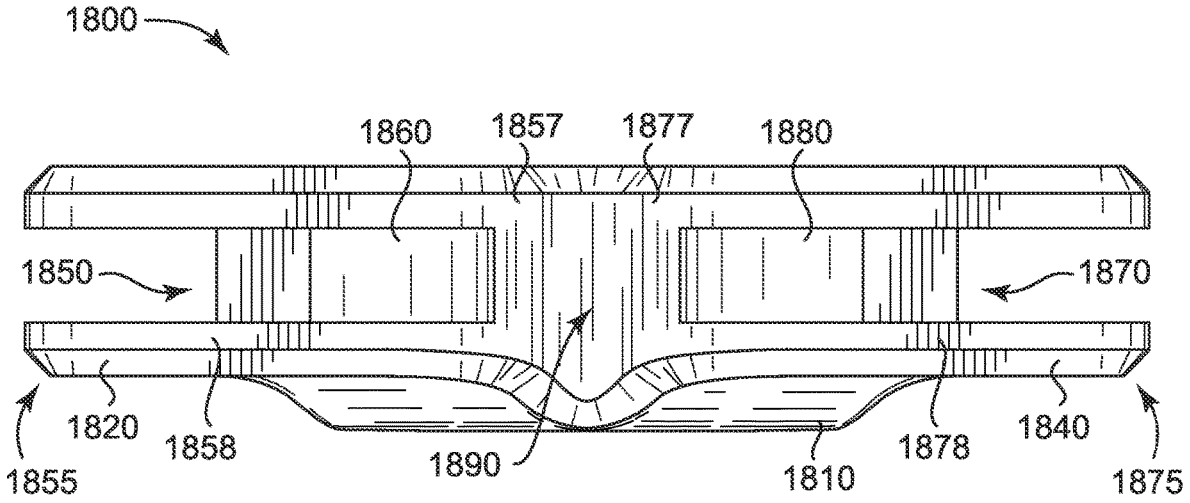
FIG. 23 depicts a rear side view of the strap connector of FIG. 18.
Figure 24:
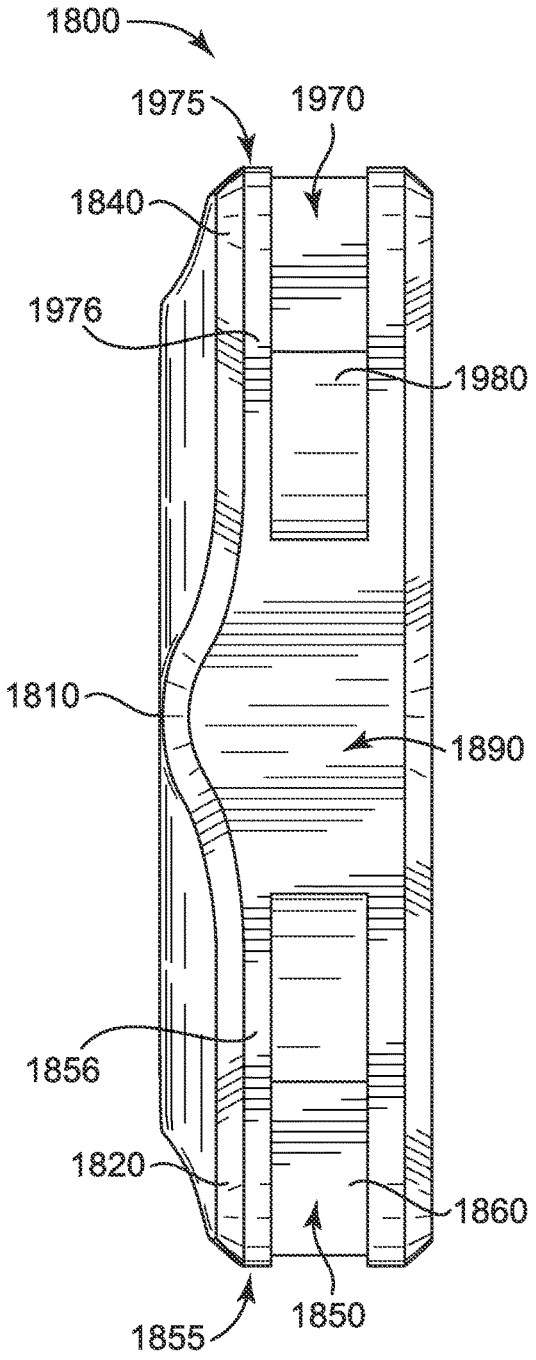
FIG. 24 depicts a left side view of the strap connector of FIG. 18.
Figure 25:
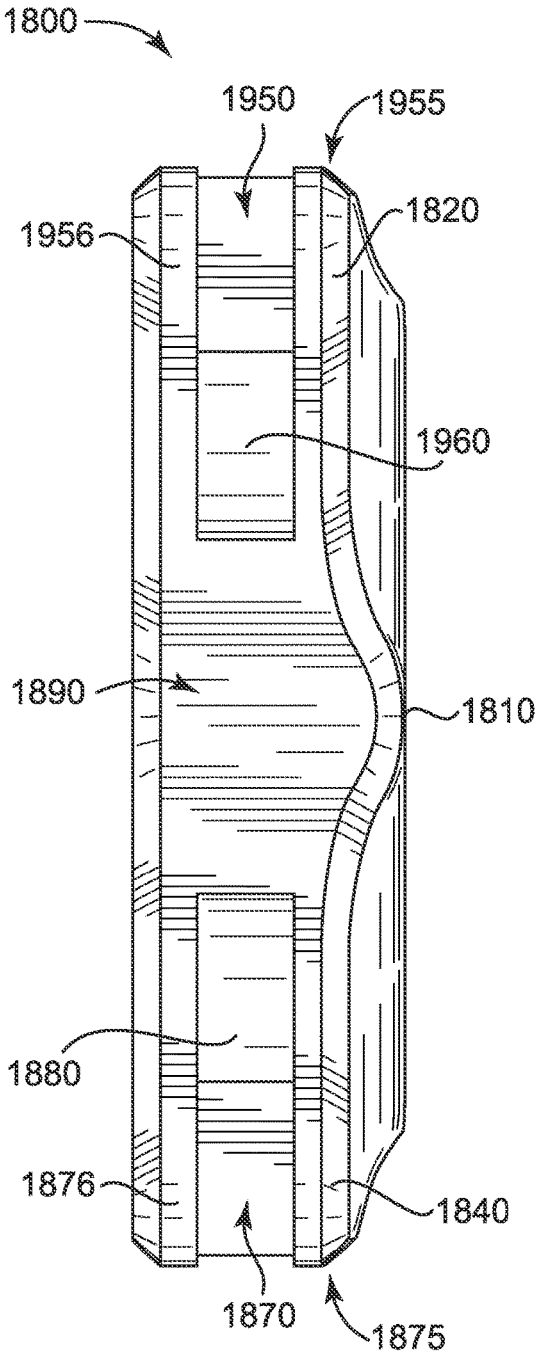
FIG. 25 depicts a right side view of the strap connector of FIG. 18.
Figure 26:
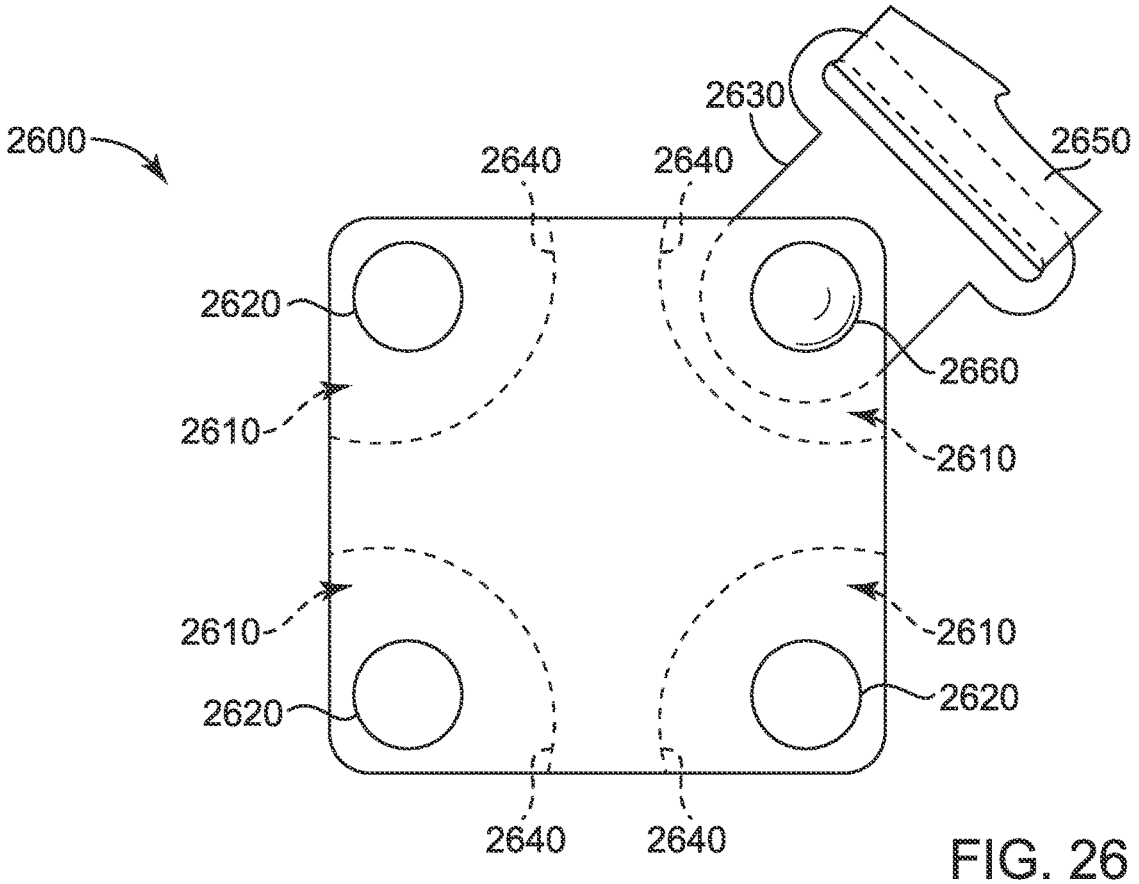
FIG. 26 depicts a bottom view of a strap connector according to an embodiment of the apparatus, methods, and articles of manufacture described herein.
Figure 27:
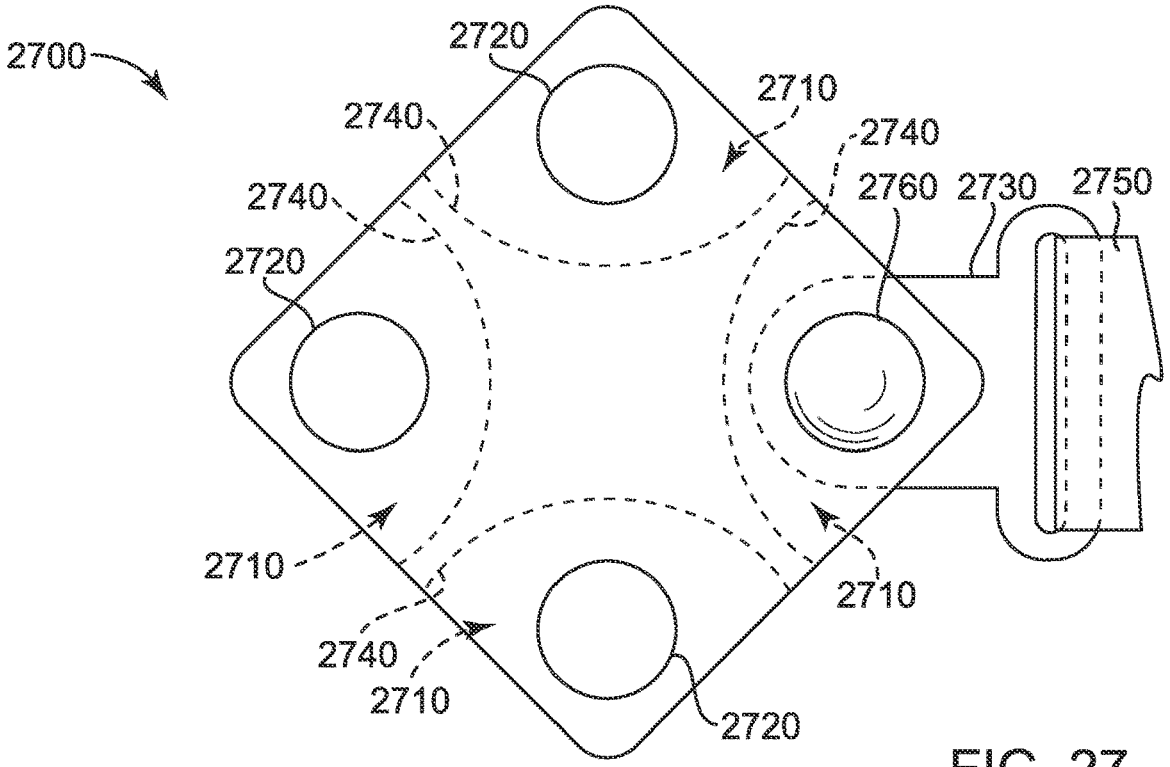
FIG. 27 depicts a bottom view of a strap connector according to an embodiment of the apparatus, methods, and articles of manufacture described herein.
Figure 28:
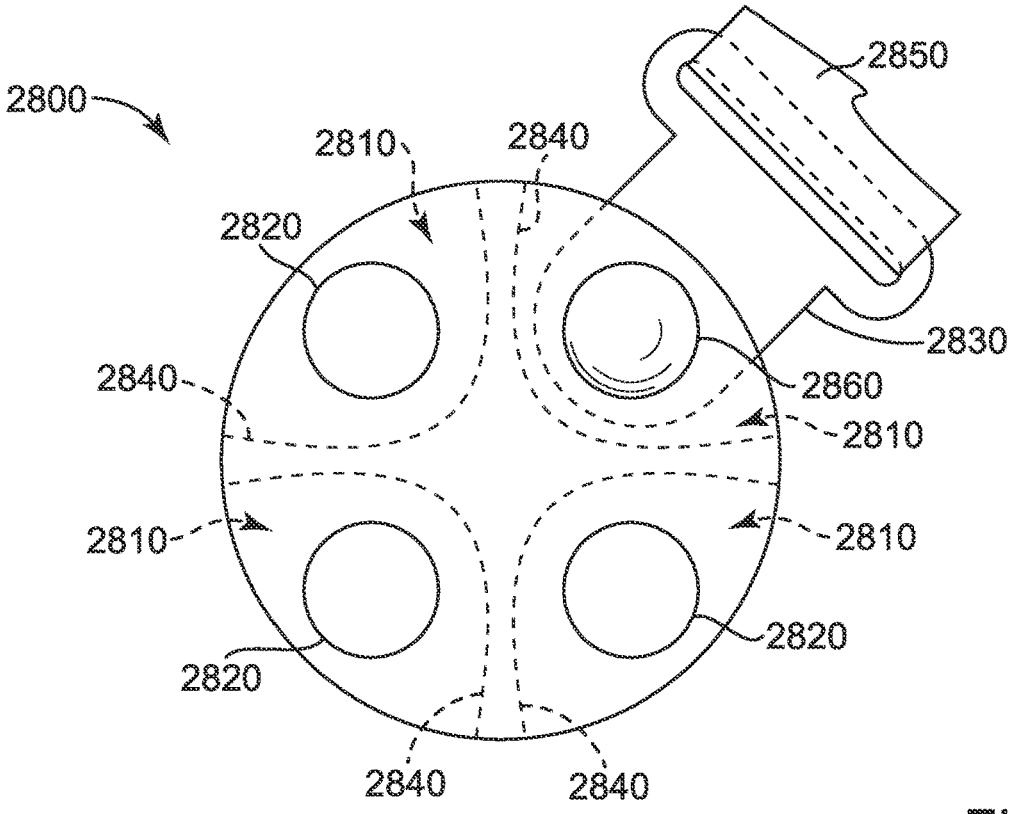
FIG. 28 depicts a bottom view of a strap connector according to an embodiment of the apparatus, methods, and articles of manufacture described herein.
Figure 29:
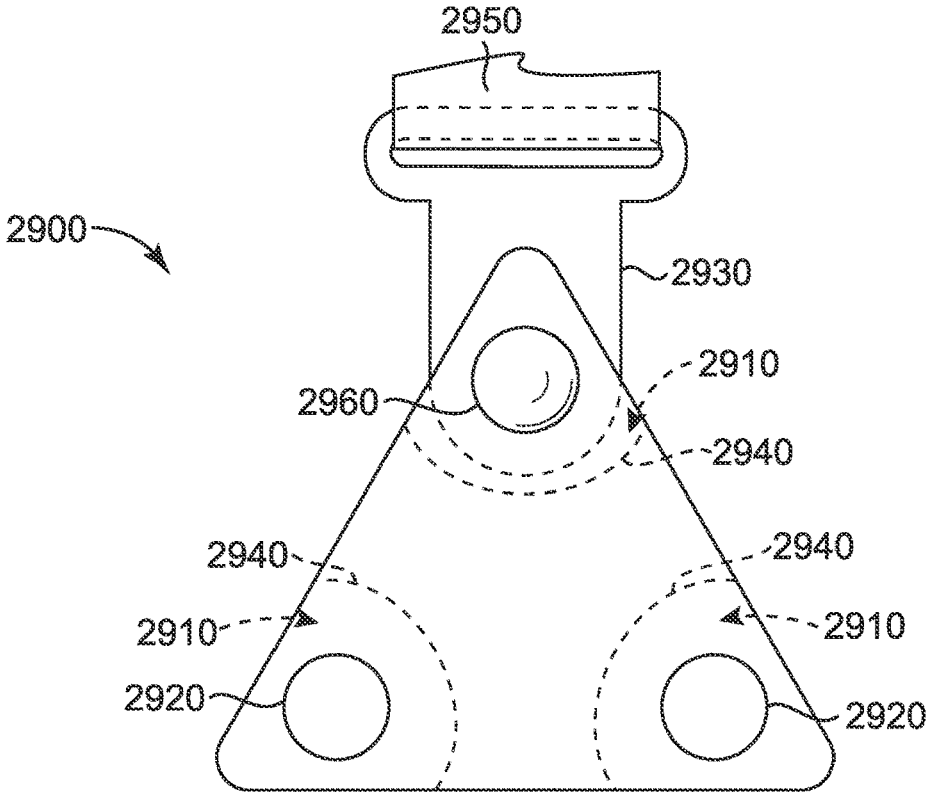
FIG. 29 depicts a bottom view of a strap connector according to an embodiment of the apparatus, methods, and articles of manufacture described herein.

As described herein, the second interior sidewall 1960 may be curved, substantially curved, linear, curvilinear, or have any other contour. The shape of the second interior sidewall 1960, and in particular, a relative angle between opposing portions of the second interior sidewall 1960 may define a range of rotational motion of the strap fitment 2120. In one example (not shown), the second interior sidewalls 1960 may include two linear and orthogonal or substantially orthogonal opposing sidewall portions. Accordingly, the second interior sidewall 1960 may limit the strap fitment 2120 to 90 degrees or approximately 90 degrees of rotation about the depressible tab 2142. In another example (not shown), the second interior sidewall 1960 may be curved and have opposing sidewall portions that are oriented 120 degrees or substantially 120 degrees relative to each other. Accordingly, the second interior sidewall 1960 may limit the strap fitment 2120 to 120 degrees of approximately 120 degrees of rotation about the depressible tab 2142. In another example, as shown in FIG. 21, the second interior sidewall 1960 may be curved and have opposing sidewall portions that are oriented at 90 degrees or approximately 90 degrees relative to each other. Accordingly, the second interior sidewall 1960 may limit the strap fitment 2120 to 90 degrees or approximately 90 degrees of rotation about the depressible tab 2142. Alternatively, the second interior sidewall 1960 may be configured to provide the strap fitment 2120 with more or less rotational freedom. The apparatus, methods, and articles of manufacture described herein are not limited in this regard.

By enabling each of the strap fitment 2120 to independently pivot relative the strap connector 1800, the strap system 2150 benefits from a self-adjusting feature that may provide a greater degree of comfort to individuals with various body types. In other words, depending on the size and proportions of an individual, the strap fitments 2120 may independently pivot to balance a golf bag on the individual's body to provide a greater degree of comfort to the individual. Further, during use of a golf bag by an individual as various golf equipment such as golf clubs may be added to and/or removed from the golf bag to change the overall weight and/or weight distribution of the golf bag, the strap fitments 2120 may independently self-pivot as needed to provide self-adjusting of the position (i.e., location, orientation) of a golf bag relative to an individual's body to continuously provide a greater degree of comfort to the individual. Alternatively, one or more slots may be configured to minimize any pivoting of a strap fitment received therein such that the strap fitment is maintained in a substantially fixed position. While not shown, additional strap fitments similar to strap fitment 2120 may be used in the first slot 1850 of the first strap arm portion 1820, the first slot 1870 of the second strap arm portion 1840, and the second slot 1970 of the second strap arm portion 1840. Accordingly, up to four strap fitments may be pivotally coupled to the strap connector 1800 to form a strap system 2150 capable of being used with golf bag 100 or another golf bag. By employing removable strap fitments, a user of the strap system 2150 may choose between a 2 strap setting that employs two strap fitments, a 3 strap setting that employs three strap fitments, and a four strap setting that employs four strap fitments. In other examples, as shown in FIGS. 26-29, the strap connector 1800 may have a different shape and/or include more or less slots and corresponding ports to enable attachment with more than four strap fitments or less than four strap fitments. The apparatus, methods, and articles of manufacture described herein are not limited in this regard.

In alternative examples, as shown in FIGS. 26-29, strap connectors 2600, 2700, 2800, and 2900 may include a square-shaped configuration, a diamond-shaped configuration, a circle-shaped configuration, and a triangle-shaped configuration, respectively. The strap connectors 2600, 2700, 2800, and 2900 may each include a plurality of slots respectively shown as slots 2610, 2710, 2810, and 2910, and a plurality of ports respectively shown as ports 2620, 2720, 2820, and 2920. The plurality of slots 2610, 2710, 2810, and 2910 may each interface with a corresponding one of the plurality of ports 2620, 2720, 2820, and 2920 to enable a strap fitment (e.g., strap fitments 2630, 2730, 2830, and 2930) to be pivotally coupled to the strap connectors 2600, 2700, 2800, and 2900 in a manner similar to the one described with respect to strap connector 1800 and strap fitment 2120. The plurality of slots 2610, 2710, 2810, and 2910 may be at least partially defined by a corresponding plurality of interior sidewalls 2640, 2740, 2840, and 2940, each of which may be curved, linear, curvilinear, or another contour selected to enhance or restrict rotational freedom of a strap fitment received in the corresponding slot. As described herein, each of the strap fitments 2630, 2730, 2830, and 2930 may be engaged to a corresponding strap 2650, 2750, 2850, and 2950 that is directly or indirectly coupled to a golf bag (e.g., golf bag 100) or another bag type. Additionally, each of the strap fitments 2630, 2730, 2830, and 2930 may include a corresponding depressible tab 2660, 2760, 2860, and 2960, which may be pivotally coupled to a port of the plurality of ports 2620, 2720, 2820, and 2920. Each of the strap fitments 2630, 2730, 2830, and 2930. The particular number of slots and corresponding ports of the strap connectors 2600, 2700, 2800, 2900 are provided for purposes of example and may be varied if desired. Likewise, the particular size and/or positions of the slots and corresponding ports of the strap connectors 2600, 2700, 2800, 2900 may also be varied. The apparatus, methods, and articles of manufacture described herein are not limited in this regard.

Although FIGS. 1 and 2 show a golf bag 100, the strap systems 102 and 2150, or any component thereof, may be used with any type of bag. Accordingly the strap systems 102 and 2150 are not limited to use with golf bags and may be used with backpacks, duffle bags, suitcases, shoulder bags, infant carriers that are attached to the body, sling-type bags, handbags, or any type of container that may be used to carry one or more objects. The apparatus, methods, and articles of manufacture described herein are not limited in this regard.

Although the strap connectors 200 and 1800 are shown and described herein to have two strap arm portions, a strap connector may include any number of arm portions. For example, a strap connector may include more than two strap arms portions or less than two strap arm portions to accommodate for more or less straps.

A strap connector, such as any of the strap connectors 1800, 2600, 2700, 2800, and 2900, may include any number of slots and corresponding ports that may provide rotational connection of strap fitments, thereby allowing each strap fitment to rotate about a certain angle (e.g., 90 degrees) to provide rotational self-adjusting of the strap fitments relative to the strap connector as described herein. The apparatus, methods, and articles of manufacture described herein are not limited in this regard.

The strap connectors 200 and 1800 may be manufactured from any material, such as metal, wood, composite materials, and/or one or more plastic materials. In one example, the strap connectors 200 and 1800 may be constructed from a rigid or substantially rigid plastic material. The strap connectors 200 and 1800 may be manufactured in two or more parts that may be bonded together to form the strap connectors 200 and 1800. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A strap system for a golf bag, the strap system comprising:

a strap connector comprising:

a body portion;

a first strap arm portion extending diagonally relative to the body portion, the first strap arm portion comprising a first longitudinal end portion and a second longitudinal end portion opposite the first longitudinal end portion;

a second strap arm portion extending diagonally relative to the body portion, the second strap arm portion comprising a third longitudinal end portion and a fourth longitudinal end portion opposite the third longitudinal end portion, the first strap arm portion and the second strap arm portion together defining an X-shaped configuration;

a plurality of slots comprising a first slot in the first longitudinal end portion, a second slot in the second longitudinal end portion, a third slot in the third longitudinal end portion, and a fourth slot in the fourth longitudinal end portion; and a plurality of ports comprising a first port extending orthogonally into the first slot, a second port extending orthogonally into the second slot, a third port extending orthogonally into the third slot, and a fourth port extending orthogonally into the fourth slot; and a plurality of self-adjusting strap fitments comprising a first self-adjusting strap fitment received in the first slot and pivotally coupled to the first port, a second self-adjusting strap fitment received in the second slot and pivotally coupled to the second port, a third self-adjusting strap fitment received in the third slot and pivotally coupled to the third port, a fourth self-adjusting strap fitment received in the fourth slot and pivotally coupled to the fourth port, wherein each of the plurality of self-adjusting strap fitments independently self-pivots relative to the strap connector.

2. A strap system as defined in claim 1, wherein each of the plurality of slots has a three-dimensional shape resembling a pie-shaped wedge and each of the plurality of ports is cylindrical.

3. A strap system as defined in claim 1, wherein the first self-adjusting strap fitment comprises:

a first connector end portion sized to fit within the first slot; and a depressible tab extending orthogonally from the first connector end portion, the depressible tab sized to fit within the first port to pivotally couple the first self-adjusting strap fitment to the strap connector.

4. A strap system as defined in claim 1, wherein the first self-adjusting strap fitment comprises:

a first connector end portion sized to fit within the first slot;

a depressible tab extending orthogonally from the first connector end portion, the depressible tab sized to fit within the first port; and a loop portion formed in the first connector end portion, the loop portion engaged to a strap that is attachable directly or indirectly to a golf bag.

5. A strap system as defined in claim 1, wherein the first slot comprises:

a first interior side wall;

a second interior side wall; and a relative angle formed between the first interior side wall and the second interior side wall, the relative angle defining a range of rotational motion of the first self-adjusting strap fitment relative to the first port.

6. A strap system as defined in claim 1, wherein the first slot comprises:

a first interior side wall;

a second interior side wall; and a relative angle formed between the first interior side wall and the second interior side wall, the relative angle defining a range of rotational motion of the first self-adjusting strap fitment relative to the first port, wherein the range of rotational motion is between 0 degrees and 90 degrees.

7. A strap system as defined in claim 1, wherein the first slot comprises:

a first interior side wall;

a second interior side wall; and a relative angle formed between the first interior side wall and the second interior side wall, the relative angle defining a range of rotational motion of the first self-adjusting strap fitment relative to the first port, wherein the range of rotational motion is between 0 degrees and 120 degrees.

8. A strap system for a golf bag, the strap system comprising:

a strap connector comprising:

a body portion;

a first strap arm portion extending diagonally relative to the body portion, the first strap arm portion comprising a first longitudinal end portion and a second longitudinal end portion opposite the first longitudinal end portion;

a second strap arm portion extending diagonally relative to the body portion, the second strap arm portion comprising a third longitudinal end portion and a fourth longitudinal end portion opposite the third longitudinal end portion;

a plurality of slots comprising a first slot in the first longitudinal end portion, a second slot in the second longitudinal end portion, a third slot in the third longitudinal end portion, and a fourth slot in the fourth longitudinal end portion; and a plurality of ports comprising a first port extending orthogonally into the first slot, a second port extending orthogonally into the second slot, a third port extending orthogonally into the third slot, and a fourth port extending orthogonally into the fourth slot; and a plurality of self-adjusting strap fitments comprising a first self-adjusting strap fitment received in the first slot and pivotally coupled to the first port, a second self-adjusting strap fitment received in the second slot and pivotally coupled to the second port, a third self-adjusting strap fitment received in the third slot and pivotally coupled to the third port, a fourth self-adjusting strap fitment received in the fourth slot and pivotally coupled to the fourth port, wherein each of the plurality of self-adjusting strap fitments independently self-pivots relative to the strap connector, wherein each of the plurality of slots has a three-dimensional shape resembling a pie-shaped wedge and each of the plurality of ports is cylindrical.

9. A strap system as defined in claim 8, wherein the first self-adjusting strap fitment comprises:

a first connector end portion sized to fit within the first slot; and a depressible tab extending orthogonally from the first connector end portion, the depressible tab sized to fit within the first port to pivotally couple the first self-adjusting strap fitment to the strap connector.

10. A strap system as defined in claim 8, wherein the first self-adjusting strap fitment comprises:

a first connector end portion sized to fit within the first slot;

a depressible tab extending orthogonally from the first connector end portion, the depressible tab sized to fit within the first port; and a loop portion formed in the first connector end portion, the loop portion engaged to a strap that is attachable directly or indirectly to a golf bag.

11. A strap system as defined in claim 8, wherein the first slot comprises:

a first interior side wall;

a second interior side wall; and a relative angle formed between the first interior side wall and the second interior side wall, the relative angle defining a range of rotational motion the first self-adjusting strap fitment relative to the first port.

12. A strap system as defined in claim 8, wherein the first slot comprises:

a first interior side wall;

a second interior side wall; and a relative angle formed between the first interior side wall and the second interior side wall, the relative angle defining a range of rotational motion of the first self-adjusting strap fitment relative to the first port, wherein the range of rotational motion is between 0 degrees and 90 degrees.

13. A strap system as defined in claim 8, wherein the first slot comprises:

a first interior side wall;

a second interior side wall; and a relative angle formed between the first interior side wall and the second interior side wall, the relative angle defining a range of rotational motion of the first self-adjusting strap fitment relative to the first port, wherein the range of rotational motion is between 0 degrees and 120 degrees.

14. A strap system for a golf bag, the strap system comprising:

a strap connector comprising:

a body portion;

a plurality of slots comprising a first slot in the body portion, a second slot in the body portion, a third slot in the body portion, and a fourth slot in the body portion; and a plurality of ports comprising a first port extending orthogonally into the first slot, a second port extending orthogonally into the second slot, a third port extending orthogonally into the third slot, and a fourth port extending orthogonally into the fourth slot; and a plurality of self-adjusting strap fitments comprising a first self-adjusting strap fitment received in the first slot and pivotally coupled to the first port, a second self-adjusting strap fitment received in the second slot and pivotally coupled to the second port, a third self-adjusting strap fitment received in the third slot and pivotally coupled to the third port, a fourth self-adjusting strap fitment received in the fourth slot and pivotally coupled to the fourth port, wherein each of the plurality of self-adjusting strap fitments independently self-pivots relative to the strap connector.

15. A strap system as defined in claim 14, wherein the body portion is square-shaped.

16. A strap system as defined in claim 14, wherein the body portion is diamond-shaped.

17. A strap system as defined in claim 14, wherein the body portion is circle-shaped.

18. A strap system as defined in claim 14, wherein the first self-adjusting strap fitment comprises:

a first connector end portion sized to fit within the first slot; and a depressible tab extending orthogonally from the first connector end portion, the depressible tab sized to fit within the first port to pivotally couple the first self-adjusting strap fitment to the strap connector.

19. A strap system as defined in claim 14, wherein the first self-adjusting strap fitment comprises:

a first connector end portion sized to fit within the first slot;

a depressible tab extending orthogonally from the first connector end portion, the depressible tab sized to fit within the first port; and a loop portion formed in the first connector end portion, the loop portion engaged to a strap that is attachable directly or indirectly to a golf bag.

20. A strap system as defined in claim 14, wherein the first slot comprises an interior wall that restricts rotational freedom of the first self-adjusting strap fitment.

* * * * *